US009194152B1

(12) United States Patent
Plasencia

(10) Patent No.: US 9,194,152 B1
(45) Date of Patent: Nov. 24, 2015

(54) CANTILEVER CANOPY

(71) Applicant: Felix M. Plasencia, Hawthorne, NJ (US)

(72) Inventor: Felix M. Plasencia, Hawthorne, NJ (US)

( * ) Notice: Subject to any disclaimer, the term of this patent is extended or adjusted under 35 U.S.C. 154(b) by 0 days.

(21) Appl. No.: 14/185,047

(22) Filed: Feb. 20, 2014

Related U.S. Application Data

(60) Provisional application No. 61/767,765, filed on Feb. 21, 2013.

(51) Int. Cl.

| | |
|---|---|
| ***E04H 15/06*** | (2006.01) |
| ***B63B 17/02*** | (2006.01) |
| ***E04H 15/34*** | (2006.01) |
| ***E04H 15/48*** | (2006.01) |

(52) U.S. Cl.
CPC ..... *E04H 15/06* (2013.01); *B63B 17/02* (2013.01); *E04H 15/34* (2013.01); *E04H 15/48* (2013.01)

(58) Field of Classification Search
CPC ..... A47C 7/66; B63B 17/02; E04H 15/48
USPC ..... 135/88.01, 88.05, 139, 140, 143, 147, 135/153, 155; 114/361
See application file for complete search history.

(56) References Cited

U.S. PATENT DOCUMENTS

| | | | | |
|---|---|---|---|---|
| 2,618,285 | A * | 11/1952 | Heisig | 135/90 |
| 2,714,387 | A | 8/1955 | Meldrum | |
| 3,032,046 | A | 5/1962 | Coondradt | |
| 4,248,255 | A | 2/1981 | Arrowsmith | |
| 5,044,298 | A | 9/1991 | Pepper et al. | |
| 5,096,257 | A * | 3/1992 | Clark | 297/184.15 |
| 5,240,020 | A * | 8/1993 | Byers | 135/96 |
| 5,579,797 | A * | 12/1996 | Rogers | 135/90 |
| 5,601,104 | A | 2/1997 | Perkins | |
| 6,626,409 | B1 * | 9/2003 | Thompson | 248/539 |
| 6,643,974 | B2 * | 11/2003 | Ruiz et al. | 43/21.2 |
| 6,848,387 | B1 | 2/2005 | Zalanka | |
| 7,004,102 | B2 * | 2/2006 | Sampson et al. | 114/364 |
| 7,093,558 | B1 | 8/2006 | Mandanici | |
| 7,243,990 | B1 * | 7/2007 | Wahl | 297/184.15 |
| 7,357,094 | B2 * | 4/2008 | Burnley et al. | 114/361 |
| 7,395,774 | B2 | 7/2008 | Borges et al. | |
| 7,540,561 | B2 | 6/2009 | McWhorter et al. | |
| 7,568,491 | B2 | 8/2009 | Banfill et al. | |
| 7,585,020 | B1 * | 9/2009 | Wahl, Jr. | 297/184.15 |
| 7,775,229 | B2 | 8/2010 | Sy-Facunda | |
| 7,931,040 | B2 * | 4/2011 | Holacka et al. | 135/154 |
| 8,056,495 | B2 | 11/2011 | Lemons | |
| 2008/0011217 | A1 | 1/2008 | Russikoff | |
| 2008/0029137 | A1 | 2/2008 | McInville | |
| 2008/0087211 | A1 * | 4/2008 | Sutherland et al. | 114/364 |
| 2011/0290170 | A1 | 12/2011 | Russikoff | |

* cited by examiner

*Primary Examiner* — Noah Chandler Hawk
(74) *Attorney, Agent, or Firm* — Frijouf, Rust & Pyle, P.A.

(57) ABSTRACT

A cantilever canopy is disclosed for extending over a surface. The cantilever canopy includes a first telescoping support member and a second telescoping support member. A telescoping coupling member is secured between the first telescoping support member and second telescoping support member. A first pivot hinge pivotably couples the first telescoping support member with a first telescoping cantilever member. A second pivot hinge pivotably couples the second telescoping support member with a second telescoping cantilever member. A screen extends between the first telescoping cantilever member and the second telescoping cantilever member for providing shelter under the screen.

8 Claims, 21 Drawing Sheets

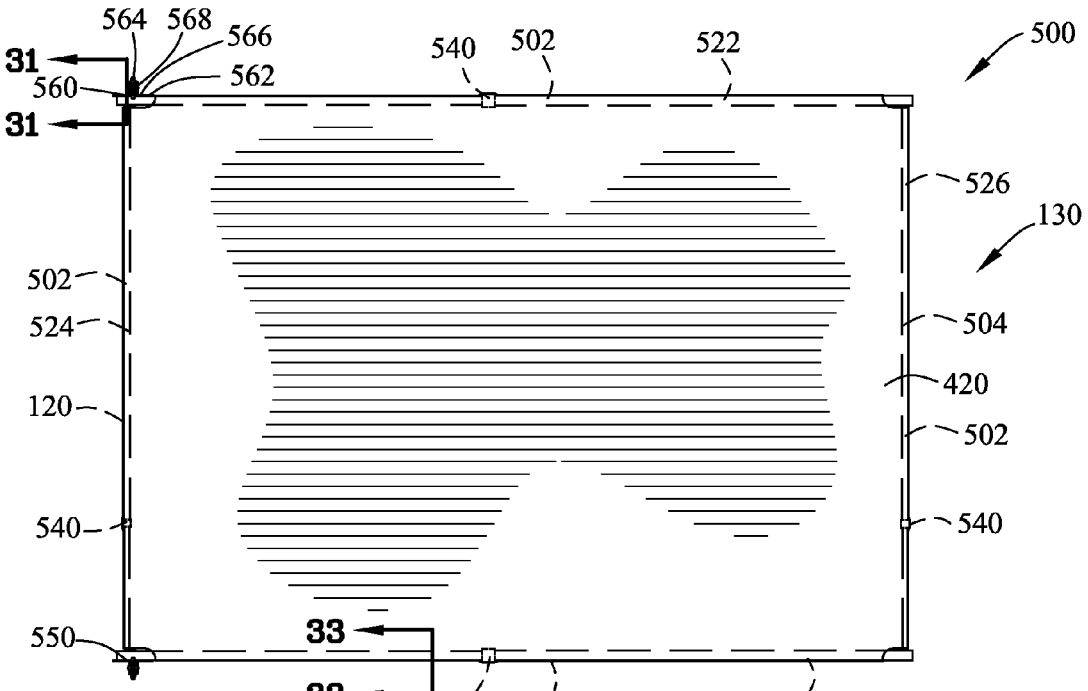
FIG. 29
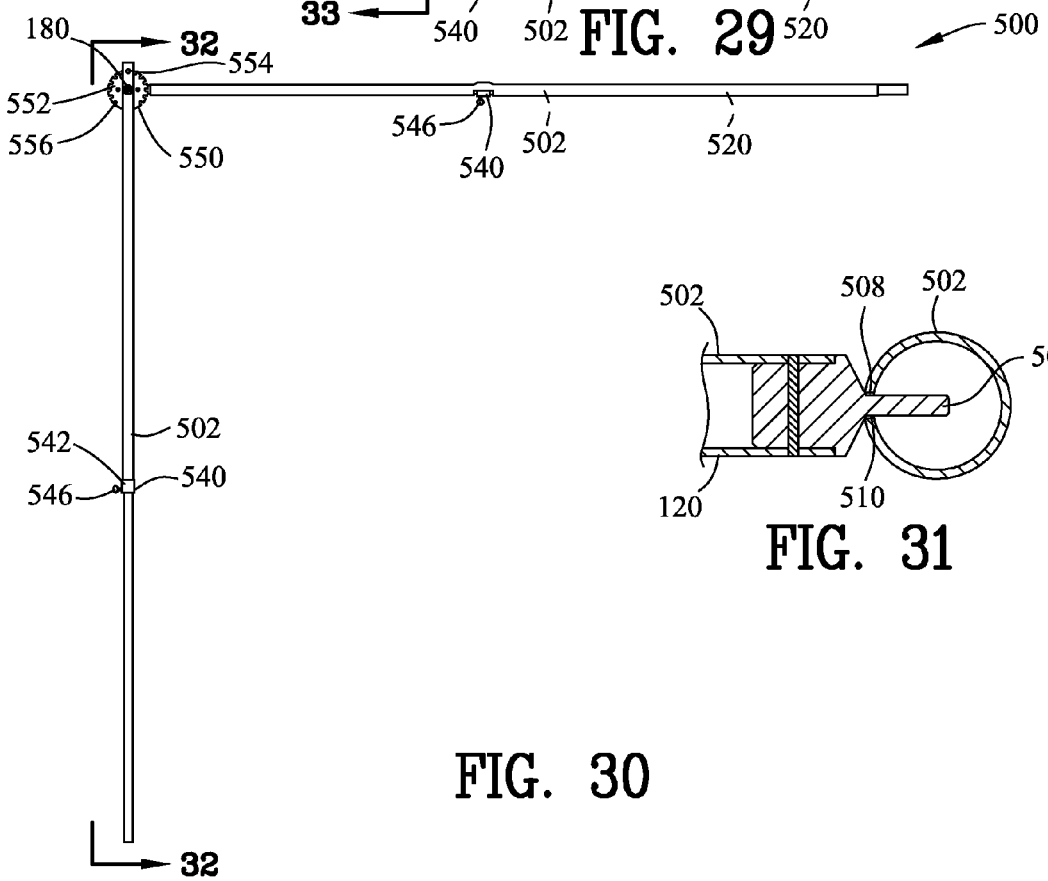
FIG. 31
FIG. 30

CANTILEVER CANOPY

FIELD OF THE INVENTION

This invention relates to shelters and more particularly to a cantilever canopy.

BACKGROUND OF THE INVENTION

Shelter from the elements, primarily sun and rain, is a major concern for designers and builders of vessels and those involved in outdoor activities. Primarily a health risk, but also a matter of physical comfort, the negative effects of long term exposure to sun is well known to those skilled in the art. A wide variety of awnings, sunshades, navy tops, bimini and T-tops have been designed and produced to provide some level of shade for the occupants of a vessel.

Although conventional boat tops provide protection for those persons inside the hull of a vessel, upon occasion coverage outside the hull maybe required. For example in tropical and sub-tropical climates, it is desirable to provide sun protection over a stern swim platform to keep the surface temperature of the platform low enough to become comfortable or even prevent burns to persons coming in contact with the platform There have been many in the prior art who have attempted to solve these problems with varying degrees of success. None, however completely satisfies the requirements for a complete solution to the aforestated problem. The following U.S. patents are attempts of the prior art to solve this problem.

U.S. Pat. No. 2,714,387 to Clarence B. Meldrum discloses a portable canopy for mounting on the sides of a boat, comprising a series of four rectangularly spaced vertical posts each including an elongated main portion having at its upper end a radial extension disposed perpendicularly to the length of the post and formed at its outer end with an upwardly extending terminal part. Each of the extensions constitutes a crank element for rotation of the main portion of the post through a circular path about the axis of its associated terminal part to selectively locate the lower ends of the posts in respect to the sides of the boat while preserving unchanged the rectangular spacing of the terminal parts. The clamp means at the lower ends of the posts engages with the sides and a rectangular canopy having at its corners openings registering with and receiving the terminal parts.

U.S. Pat. No. 3,032,046 to Robert A. Coonradt discloses an awning comprising a post, a mounting means on the lower end of the post and a horizontally disposed sleeve positioned on one side of the post adjacent to the upper end thereof and fixedly secured to the post. An awning frame includes a pair of spaced side members, a cross member extends between and is secured to each of the adjacent ends of the side members. A spreader bar extends transversely between the mid points of the side members and has its ends pivotally connected to the side members. The frame is horizontally disposed on the side of the post adjacent the sleeve and having one of its cross members extending through and rigidly affixed to the sleeve. A U-shaped section embodying a bight and a pair of legs projecting from the bight positioned outwardly of each side member with the bight positioned outwardly of each side member with the bight extending along and parallel to the adjacent side member and the legs perpendicular to the adjacent side member and having the free ends of its legs hingedly connected to the adjacent side member. A stretcher cord extends between and is operatively connected to the mid points of the bights of the sections for holding the sections in position outwardly of the side members of the awning frame.

U.S. Pat. No. 4,248,255 to Chalotte A. Arrowsmith discloses a floating canopy for use in association with a floating body supporting device having a rigid flat base, a vertical support member, and an upper canopy frame. Flotation means associated with the base maintains the canopy in upright position when in water. The vertical support member may be detached from the base and used on a lawn chair by attaching with a C-clamp.

U.S. Pat. No. 5,044,298 to Geoffrey T. Pepper, et al. discloses a boat comprising a deck having thereon a helm, and a canopy operable in a first mode wherein the canopy is spaced a first distance above the deck and a second mode wherein the canopy is spaced a second distance less than the first distance above the deck and wherein the canopy permits an operator to be positioned at the helm.

U.S. Pat. No. 5,601,104 to Walter R. Perkins discloses a portable canopy adapted to extend in an horizontal plane outward from the rear of a vehicle and which is supported and maintained in its erected position by the rear wheels of the vehicle. The canopy of the invention can be quickly disassembled or assembled and carried in a convenient package in the trunk or other storage facility of the vehicle and provides an easy-to-use stable awning for picnics or other events occurring proximate to the motor vehicle.

U.S. Pat. No. 6,848,387 to Craig Zalanka discloses a low sun angle shade preferably adapted to be attached to and carried on a rigid side or end margin of a bimini top, T-top and the like for a boat. The sunshade includes an elongated shade panel formed of substantially opaque material and pivotal connectors on one longitudinal margin of the shade panel adapted for attachment to, and selected pivotal movement of, the shade panel with respect to the side or end margin of the bimini top or T-top. The shade panel is thereby selectively pivotally moveable about a pivotal axis passing through the pivotal connectors between a deployed or outstretched downwardly extending position with respect to the bimini top or T-top wherein low-to-the-horizon sun is substantially block from a boat operators or passengers eyes and a stored position doubled over and positioned against a corresponding side or end portion of the bimini top or T-top. Collapsible embodiments are also provided.

U.S. Pat. No. 7,093,558 to Glenn Mandanici discloses a convertible boat top which is mounted on a bass or flats type boat and can be selectively deployed in an extended, functional position to cover occupants of the boat. A stowed, storage position on the side of the boat prevents interference of the boat top with occupants engaged in fishing or other boating activities. The convertible boat top includes a pair of support stanchions for engaging the boat and a pair of attachment stanchions for engaging the boat in spaced-apart relationship to the support stanchions. A retractable boat top is selectively extendable from the support stanchions and removably engages the attachment stanchions to cover and shield occupants in the boat from adverse weather conditions.

U.S. Pat. No. 7,395,774 to Juan Alberto Borges discloses a retractable canopy structure adapted to be used in conjunction with the canopy structure on a boat's existing T-top tubular frame near the level of the existing canopy. The canopy frame structure comprises two longitudinally aligned, telescoping members with at least one transverse, telescoping frame member disposed between the two longitudinal members to prevent the canopy from collapsing when under tension. The canopy frame structure is disposed onto the existing T-top frame using a mounting assembly comprising of a grommet adapted to be placed between two frame members and wrapped with an adjustable strap. The canopy and telescoping frame components are designed to be adaptable to various T-top canopy widths, and can be extended to various lengths to increase the amount of available canopy shade area while in the mounted position on the boat's existing T-top.

U.S. Pat. No. 7,540,561 to Joe McWhorter, et al. discloses an apparatus for providing shade to an individual, adjustable in three planes. In some embodiments, the shading apparatus include a primary shaft secured to a fixed base such as a pedestal seat. A height adjustable and telescoping secondary shaft is inserted concentrically into the primary shaft. A pivot joint assembly is secured to the secondary shaft, and a shading device is mounted to the pivot joint assembly. The pivot joint assembly allows for rotational, pivoting, and sliding adjustment in order to provide positional flexibility to the individual seeking shade.

U.S. Pat. No. 7,568,491 to Jeffrey A. Banfill, et al. discloses a vehicle-mounted awning with a quick setup framework that supports a weatherproof fabric canopy, and is configured for use to the rear of a vehicle. A multi-sectioned bumper bar attaches to the hitch receiver of a vehicle. Opposing ends of the bumper bar have vertical extension pieces, each extending vertically and having a slightly arcuate free end for support of an arcuate multi-sectioned upper side panel frame on either side of the bumper bar. Multi-sectioned lower side panel frames are pivotally connected to opposing ends of the bumper bar. Upper and lower side panel frames are removably connected at their distal ends to provide cantilevered support. Additional multi-sectioned framework extends rearward protective coverage. A flexible water-resistant fabric is wrapped over the support framework to provide a covered canopy region. The framework of the device comprises a plurality of collapsible elements for storage in a small bag.

U.S. Pat. No. 7,775,229 to Ron Sy-Facunda discloses a collapsible canopy shelter having one or more side awnings that are pivotally coupled to the canopy frame. The canopy shelter for this has reinforced eaves for additional structural integrity, as well as at least one collapsible ventilation flap in the canopy cover that is capable of moving between a closed position and an open position to ventilate air from beneath the canopy cover as desired. Further, the collapsible canopy shelter comprises a canopy frame with a robust, spring-loaded pull latch, allowing the user to quickly and easily assemble and, collapse the shelter without risking in jury.

U.S. Pat. No. 8,056,495 to Daniel E. Lemons discloses a bimini extender which fits overlappingly onto and extends forward of a pontoon's primary bimini for extended shade. The bimini extender includes a flexible cover that is at least about one-third of the deck surface area of the pontoon boat, a framework configured for attachment to one or both of the deck and pontoon's perimeter railing, a rear attachment structure for attaching the flexible cover to one of the deck, perimeter railing, and primary bimini, and a front attachment structure for attaching the flexible cover to the framework. The flexible cover shades an "extra" portion of the deck surface area. The bimini extender is made to be collapsible, removable, and storable, and further is made with robust and lower-cost components including a novel railing clamp, yet is aesthetic, durable and easily installable/removable.

United States Patent Application 2008-0011217 to Ronald K. Russikoff discloses a retractable bimini top device for automated operation and mounted attachment to an existing rooftop member set over the deck of a boat. The inventive device includes a U-shaped support frame having respective side legs adapted to travel longitudinally through a pair of housing tube members disposed in parallel and mounted beneath the rooftop member. The side legs of the U-shaped frame are coaxially fitted within the housing tube members and made to travel together in unison through the respective tube members, each upon a lead screw that is driven by a reversible motor electrically powered and mounted at the end of each tube. A canvas cover attached along its outer end to the transverse portion of the U-shaped frame is stored in a rolled-up state about a spring-loaded roller mounted transversely between the housing tube members so that the canvas cover may be extended in a substantially horizontal manner and retracted as the side legs of the support frame are moved in alternate linear directions through the housing tube members.

United States Patent Application 2008-0029137 to Randy Walter McInville discloses a height-adjustable tubular holder for an elongated rod, such as an umbrella or fishing rod. A bracket is dimensioned for attachment to preexisting bolts, such as on a boat seat. The bracket supports the tubular holder in such a manner as to facilitate angular adjustment of the supported rod, and wherein the holder can be rotated out of position during periods of non-use.

United States Patent Application 2011-0290170 to Ronald K. Russikoff discloses a manually-operated canopy deployment system for mounted attachment to existing rooftop or bridge structure of recreational boats. The system comprises a pair of spring-loaded tubular actuators telescopically assembled and coupled in parallel alignment to deploy a flexible canvas from a roller member transversely mounted between the actuators with a gear box operatively connected to the roller member to control the canvas deployment. Each actuator assembly includes a rearward outer tube closed at its back end, separate forward and intermediate interior tubes each fitted with inner end caps and coaxially disposed to move longitudinally within the outer tube, and compression springs separately disposed within the respective chambers of the outer tube and intermediate interior tube to apply outbound forces axially upon the inner ends of the respective interior tubes. Sleeve members disposed between the respective tubes at their forward ends provide bearing surfaces that stabilize their telescoping movement. Forward and intermediate cross bars transversely mounted and connected across outer ends of the interior tubes serve to draw the canvas from the roller member and support canvas deployment, with a pair of loop attachments provided on the surface of the canvas to engage the intermediate cross bar upon full deployment of the canvas and prevent billowing thereof.

Although the aforementioned prior art have contributed to the development of the art of vessel canopies and tops, none of these prior art patents have solved the needs of this art.

Therefore, it is an object of the present invention to provide an improved apparatus for vessel canopies and tops.

Another object of this invention is to provide an improved apparatus for providing protection from the sun external to the hull of a vessel.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a ill understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved cantilever canopy for extending over a surface. The cantilever canopy includes a first telescoping support member extending between a proximal end and a distal end. A second telescoping support member extends between a proximal end and a distal end. A telescoping coupling member is secured to the distal end of the first telescoping support member and the distal end of the second telescoping support member. A first telescoping cantilever member extends between a proximal end and a distal end. A second telescoping cantilever member extends between an proximal end and a distal end. A first pivot hinge pivotably couples the distal end of the first telescoping support member with the proximal end of the first telescoping cantilever member. A second pivot hinge pivotably couples the distal end of the second telescoping support member with the proximal end of the second telescoping cantilever member. The first telescoping support member and the second telescoping support member provide a first canopy height and a second canopy height. The telescoping coupling member provides a first canopy width and a second canopy width. The first telescoping cantilever member and the second telescoping cantilever member provide a first canopy length and a second canopy length. The first pivot hinge provides a first angle and a second angle between the first telescoping support member and the first telescoping cantilever member. The second pivot hinge provides a third angle and a fourth angle between the second telescoping support member and the second telescoping cantilever member. A first anchor couples the proximal end of the first telescoping support member to the surface. A second anchor couples the proximal end of the second telescoping support member to the surface. A screen extends between the first telescoping cantilever member and the second telescoping cantilever member for providing shelter under the screen.

In a more specific embodiment of the invention, a first pivot lock terminates pivoting of the first, telescoping support member relative to the first telescoping cantilever member. A second pivot lock terminates pivoting of the second telescoping support member relative to the second telescoping cantilever member.

In one embodiment of the invention, the first anchor includes a first fishing rod plug for inserting into a first fishing rod holder. The second anchor includes a second fishing rod plug for inserting into a second fishing rod holder.

In one embodiment of the invention, the first anchor includes a first cleat clamp for engaging with a first cleat. The second anchor includes a second cleat clamp for engaging with a second cleat.

In one embodiment of the invention, the first anchor includes a first boat hull clamp for engaging a first hull side. The second anchor includes a second boat hull clamp for engaging a second hull side.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a filler understanding of the nature and objects of the invention, reference should be made to the following detailed description taken in connection with the accompanying drawings in which:

FIG. 15 is a view similar to FIG. 4 illustrating the first telescoping support member and the first telescoping cantilever member having a 90° angle there between;

FIG. 16 is a view similar to FIG. 15 illustrating the first telescoping support member and the first telescoping cantilever member having an acute angle there between;

FIG. 29 is an enlarged view of the cantilever canopy as shown in FIG. 28;

FIG. 30 is a side view of FIG. 29;

FIG. 31 is a sectional view along line 31-31 in FIG. 29 illustrating the second telescoping cantilever member including a support aperture for receiving a second coupling member pin;

FIG. 39 is a view similar to FIG. 30 illustrating the first telescoping support member and the first telescoping cantilever member having a 90° angle there between;

FIG. 40 is a view similar to FIG. 39 illustrating the first telescoping support member and the first telescoping cantilever member having an acute angle there between;

Similar reference characters refer to similar parts throughout the several Figures of the drawings.

DETAILED DISCUSSION

Figure 1:
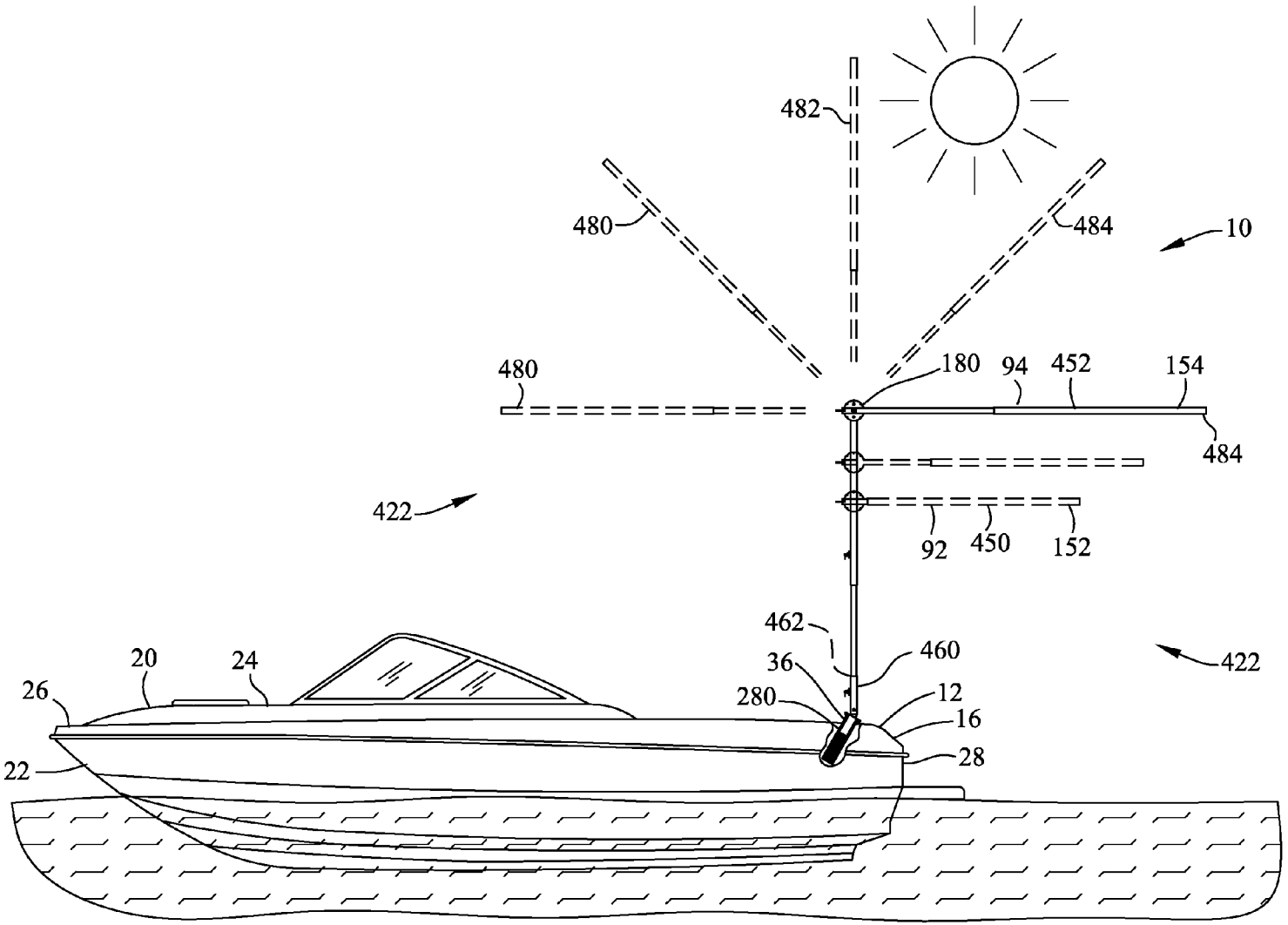
FIG. 1 is a side view of a cantilever canopy for extending over a surface of the present invention.

FIGS. 1-26 are various views of a cantilever canopy 10 for extending over a surface 12. The surface 12 may include but is not limited to a ground surface 14, a boat surface 16 and an automobile surface 18. As shown in FIGS. 1, 2, 19-21 and 24-26, the cantilever canopy 10 may be utilized on a boat 20. The boat 20 includes a hull 22 and a deck 24 extending between a bow 26 and a stern 28. The hull 22 extends between a first hull side 30 and a second hull side 32. The boat 20 has a gunwale 34 along the upper edge of the first hull side 30 and the second hull side 32. The boat 20 may further include a first fishing rod holder 36 and a second fishing rod holder 38 positioned on the first boat side 40 and the second boat side 42, respectively. The boat 20 may include a first cleat 44 engaging the first hull side 30 and a second cleat 46 for engaging the second hull side 32.

Figure 22:
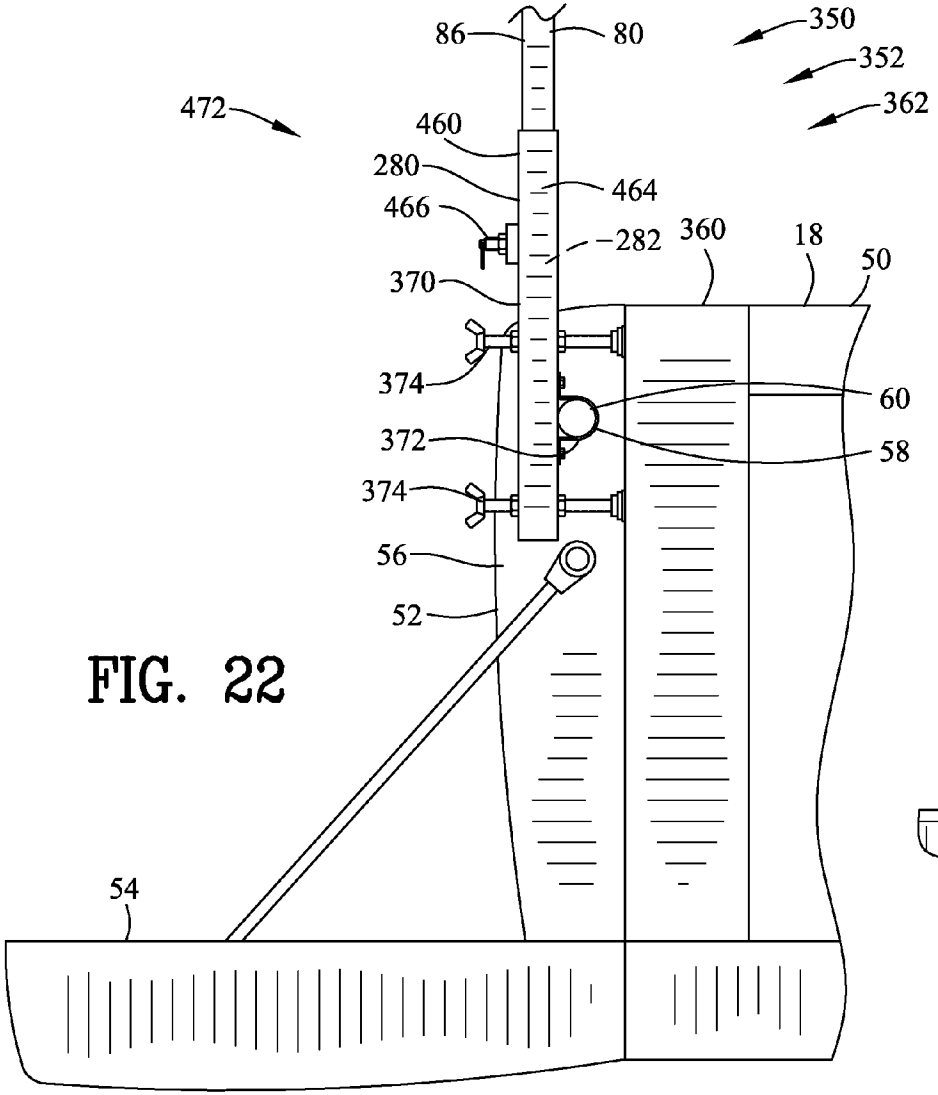
FIG. 22 is a side view of a first truck bed side receiving the first anchor including a first truck bed clamp.

FIG. 22 illustrate the cantilever canopy 10 being utilized with a truck bed 50. The truck bed 50 includes an opening 52, wherein a tailgate 54 is pivotably mounted for accessing the truck bed 50 when the tailgate 54 is in an open position. The opening 52 includes a jamb frame 56. A tailgate latch 58 retains the tailgate 54 in a closed position. The tailgate latch 58 includes a tailgate locking shaft 60 that is positioned within the jamb frame 56.

Figure 4:
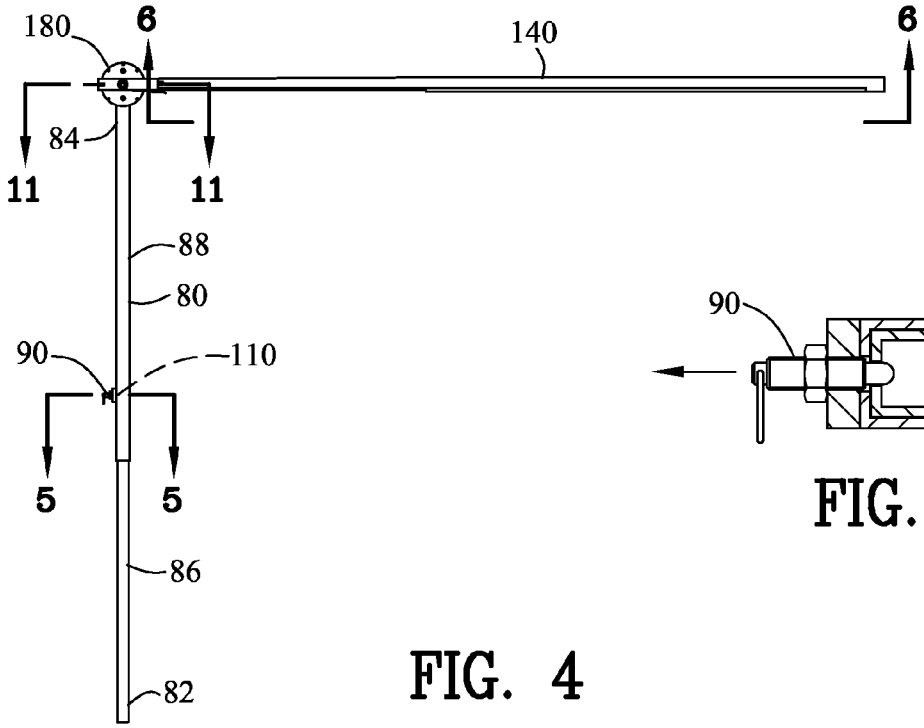
FIG. 4 is a side view of FIG. 3.
Figure 5:
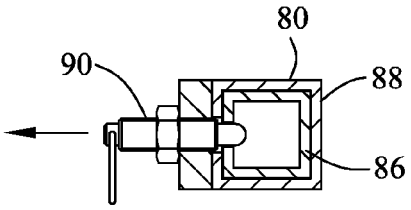
FIG. 5 is a sectional view along line 5-5 in FIG. 4 illustrating a pull-pin utilized with the first telescoping support member for varying the height of the first telescoping support member.

As best shown in FIGS. 4 and 5, the cantilever canopy 10 includes a first telescoping support member 80 extending between a proximal end 82 and a distal end 84. The first telescoping support member 80 is defined by a primary member 86 and a secondary member 88. The primary member 86 has a smaller cross-sectional area then the secondary member 88 for permitting the primary member 86 to slidably engage within the secondary member 88. A first support member pin 90 traverses the primary member 86 and the secondary member 88 for terminating displacement between the primary member 86 and the secondary member 88. The first support member pin 90 maybe withdrawn from the secondary member 88 for permitting the displacement between the primary member 86 and the secondary member 88 for defining a first canopy height 92 and a second canopy height 94. The first telescoping support member 80 is illustrated as having a square cross-sectional geometry for preventing rotation of the primary member 86 relative to the secondary member 88, however, the cross-sectional geometry of the first telescoping support member 80 may include other geometric shapes.

Figure 9:
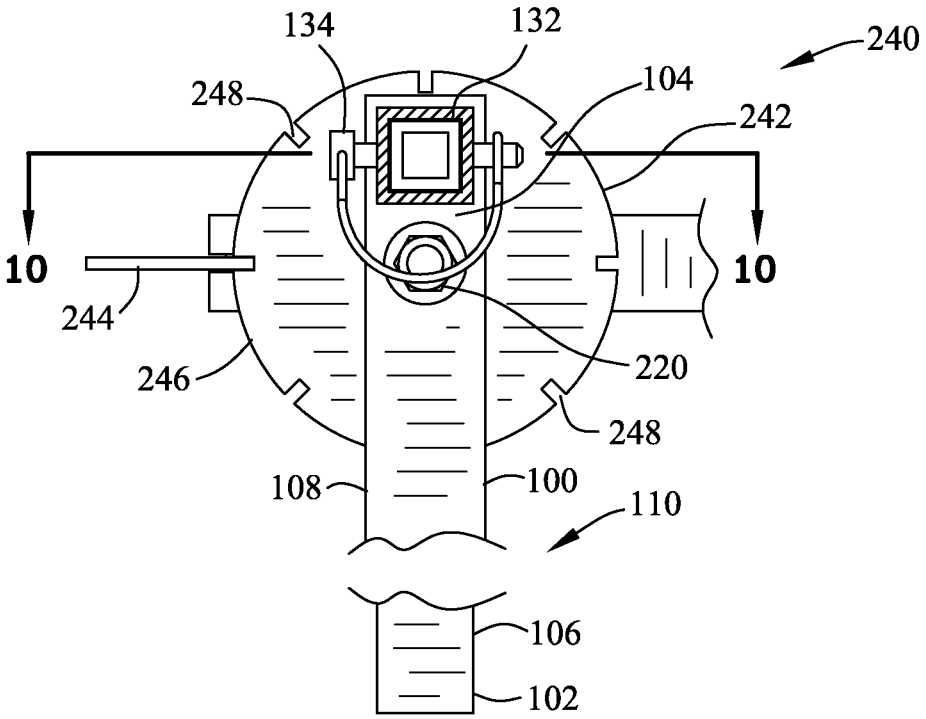
FIG. 9 is a sectional view along line 9-9 in FIG. 3 illustrating a second pivot lock for terminating pivoting of the second telescoping support member relative to the second telescoping cantilever member.

As best shown in FIG. 9, a second telescoping support member 100 extends between a proximal end 102 and a distal end 104. The second telescoping support member 100 is defined by a primary member 106 and a secondary member 108. The primary member 106 has a smaller cross-sectional area then the secondary member 108 for permitting the primary member 106 to slidably engage within the secondary member 108. A second support member pin 110 traverses the primary member 106 and the secondary member 108 for terminating displacement between the primary member 106 and the secondary member 108. The first support member pin 110 maybe withdrawn from the secondary member 108 for permitting the displacement between the primary member 106 and the secondary member 108 for defining the first canopy height 92 and the second canopy height 94. The second telescoping support member 100 is illustrated as having a square cross-sectional geometry for preventing rotation of the primary member 106 relative to the secondary member 108, however, the cross-sectional geometry of the first telescoping support member 100 may include other geometric shapes.

Figure 7:
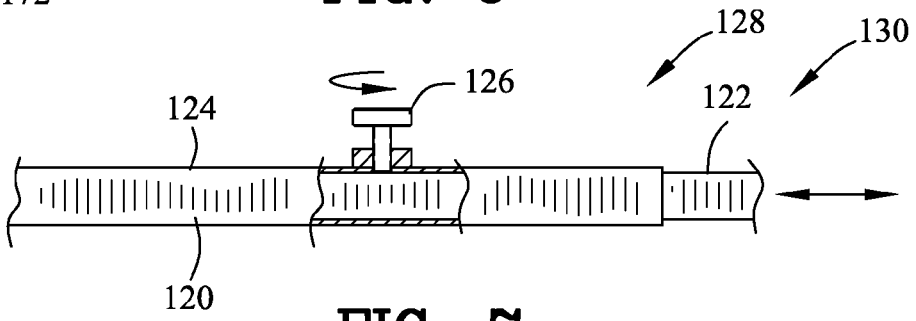
FIG. 7 is an enlarged view of a portion of FIG. 3 illustrating a telescoping coupling member for providing a first canopy width and a second canopy width.
Figure 10:
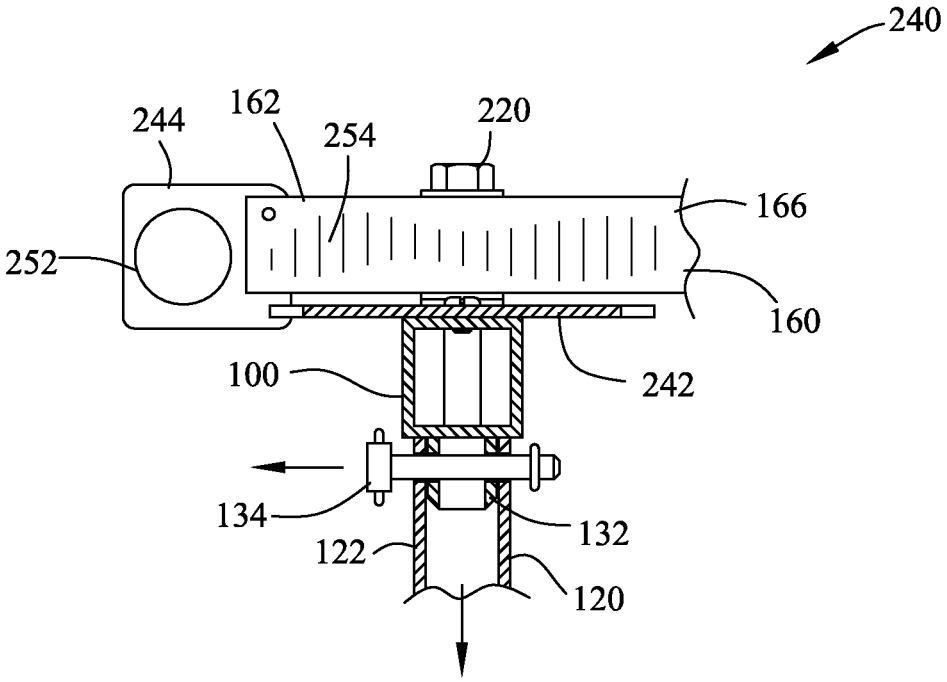
FIG. 10 is a sectional view along line 10-10 in FIG. 9.

As best shown in FIG. 7, a telescoping coupling member 120 is secured to the distal end 84 of the first telescoping support member 80 and the distal end 104 of the second telescoping support member 100. The telescoping coupling member 120 is defined by a primary member 122 and a secondary member 124. The primary member 122 has a smaller cross-sectional area then the secondary member 124 for permitting the primary member 122 to slidably engage within the secondary member 124. A threaded coupling pin 126 traverses the primary member 122 and the secondary member 124 for terminating displacement between the primary member 122 and the secondary member 124. The threaded coupling pin 126 maybe withdrawn from the secondary member 124 for permitting the displacement between the primary member 122 and the secondary member 124 for defining the first canopy width 128 and the second canopy width 130. The telescoping coupling member 120 is illustrated as having a square cross-sectional geometry for preventing rotation of the primary member 122 relative to the secondary member 124, however, the cross-sectional geometry, of the telescoping coupling member 120 may include other geometric shapes. As best shown in FIGS. 9 and 10, the telescoping coupling member 120 may be secured to both the first telescoping support member 80 and the second telescoping support member 100 by a mounting bolt 132 position within the first telescoping support member 80 and the second telescoping support member 100 and a coupling pin 134. The engagement between the mounting bolt 132 and the coupling pin 134 allows for prompt separation of the telescoping coupling member 120 from both the first telescoping support member 80 and the second telescoping support member 104 for facilitating the storage or transportation of the cantilever canopy.

Figure 6:
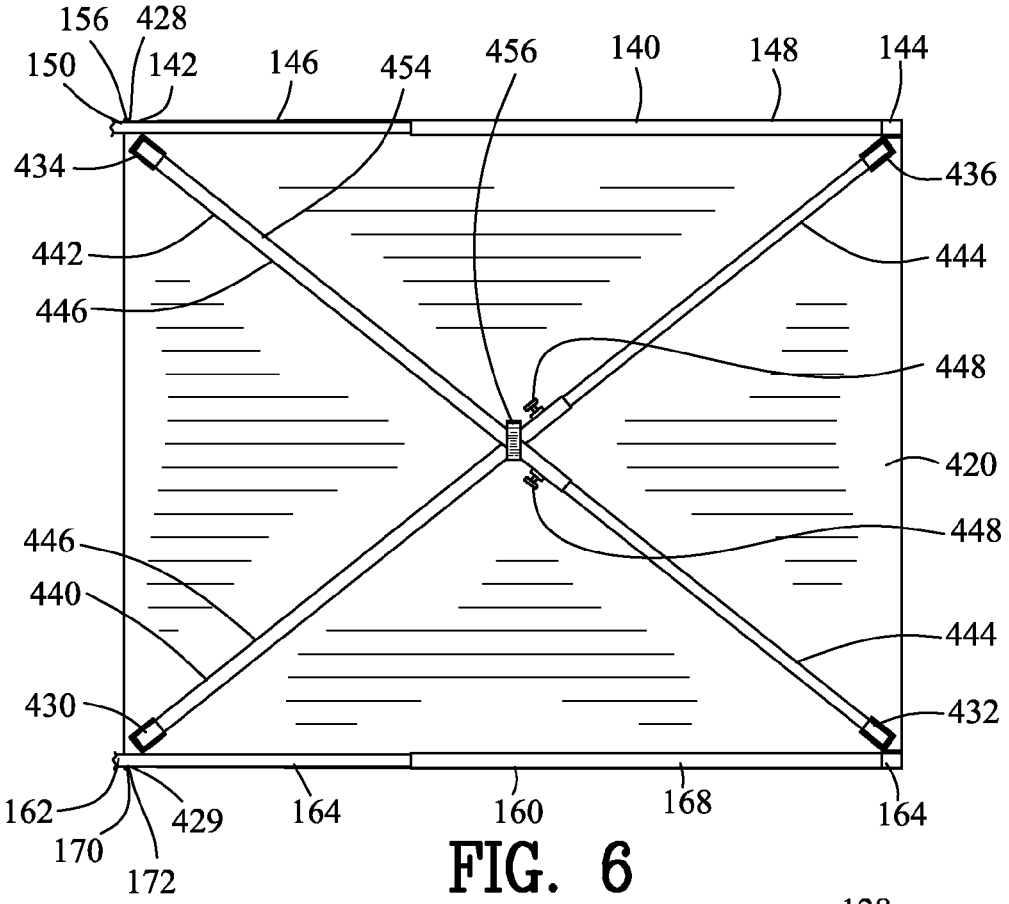
FIG. 6 is a bottom view of FIG. 3.
Figure 8:
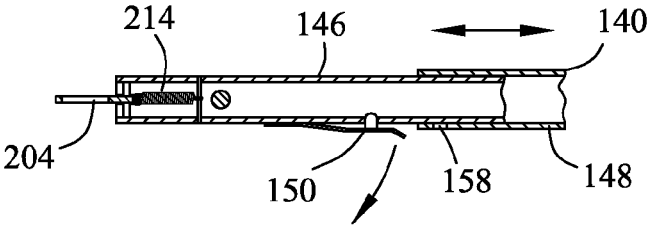
FIG. 8 is a sectional view along line 8-8 in FIG. 3 illustrating a first telescoping cantilever member providing a first canopy length and a second canopy length.

As best shown in FIGS. 6 and 8, a first telescoping cantilever member 140 extends between a proximal end 142 and a distal end 144. The first telescoping cantilever member 140 is defined by a primary member 146 and a secondary member 148. The primary member 146 has a smaller cross-sectional area then the secondary member 148 for permitting the primary member 146 to slidably engage within the secondary member 148. The length of the first telescoping cantilever member 140 may be altered by displacing the primary member 146 relative to the secondary member 148 for defining a first canopy length 152 and a second canopy length 154. The first telescoping cantilever member 140 is illustrated as having a square cross-sectional geometry for preventing rotation of the primary member 146 relative to the secondary member 148, however, the cross-sectional geometry of the first telescoping cantilever member 140 may include other geometric shapes.

As best shown in FIG. 8, a first levered pin 150 is coupled to the first telescoping cantilever member 140 for engaging with a contraction aperture 158 located within the secondary member 148 of the first telescoping cantilever member 140. The first levered pin 150 engages into the contraction aperture 158 upon the first telescoping cantilever member 140 positioning into a fully contracted position. The coupling of the first levered pin 150 into the contraction aperture 158 is utilized to maintain the first telescoping cantilever member 140 in a contraction position.

As best shown in FIG. 6, a second telescoping cantilever member 160 extends between a proximal end 162 and a distal end 164. The second telescoping cantilever member 160 is defined by a primary member 166 and a secondary member 168. The primary member 166 has a smaller cross-sectional area then the secondary member 168 for permitting the primary member 166 to slidably engage within the secondary member 168. The length of the second telescoping cantilever member 160 may be altered by displacing the primary member 166 relative to the secondary member 168 for defining the first canopy length 152 and the second canopy length 154. The second telescoping cantilever member 160 is illustrated as having a square cross-sectional geometry for preventing rotation of the primary member 146 relative to the secondary member 148, however, the cross-sectional geometry of the first telescoping cantilever member 140 may include other geometric shapes.

As best shown in FIG. 8, a second levered pin 170 is coupled to the second telescoping cantilever member 160 for engaging with a contraction aperture 158 located within the secondary member 148 of the second telescoping cantilever member 160. The second levered pin 170 engages into the contraction aperture 158 upon the second telescoping cantilever member 160 positioning into a fully contracted position. The coupling of the second levered pin 170 into the contraction aperture 158 is utilized to maintain the second telescoping cantilever member 160 in a contraction position.

Figure 11:
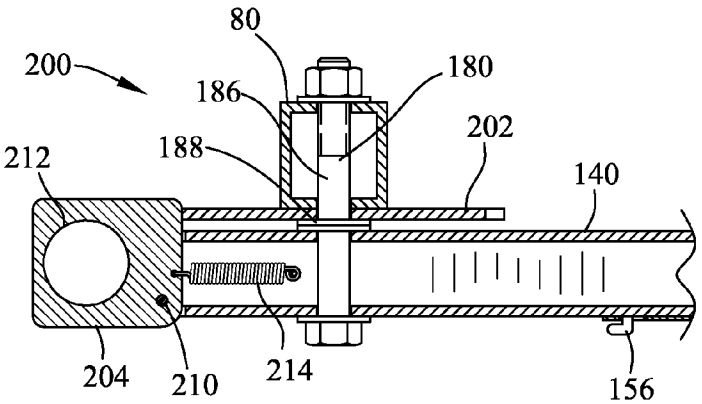
FIG. 11 is a sectional view along line 11-11 in FIG. 4 illustrating a first locking key engaging a locking groove for terminating pivoting of the first telescoping support member relative to the first telescoping cantilever member.
Figure 12:
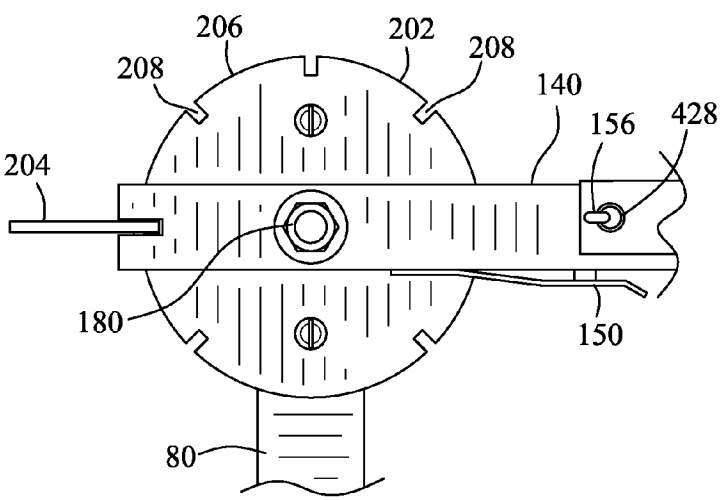
FIG. 12 is a side view of FIG. 11.
Figure 13:
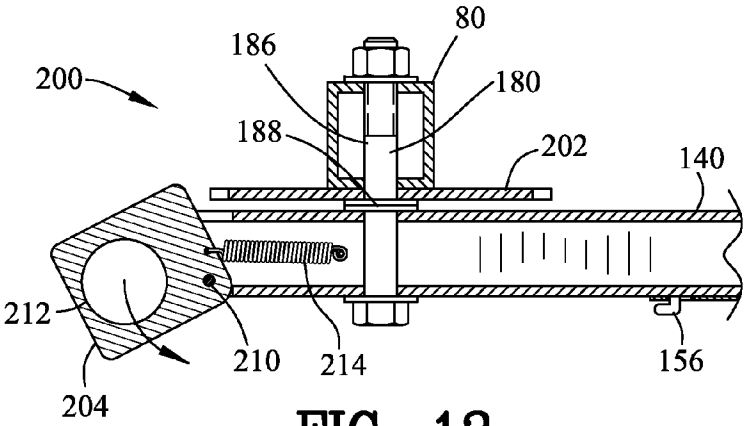
FIG. 13 is a view similar to FIG. 11 illustrating the first locking key being disengaged with the locking groove for permitting pivoting of the first telescoping support member relative to the first telescoping cantilever member.
Figure 14:
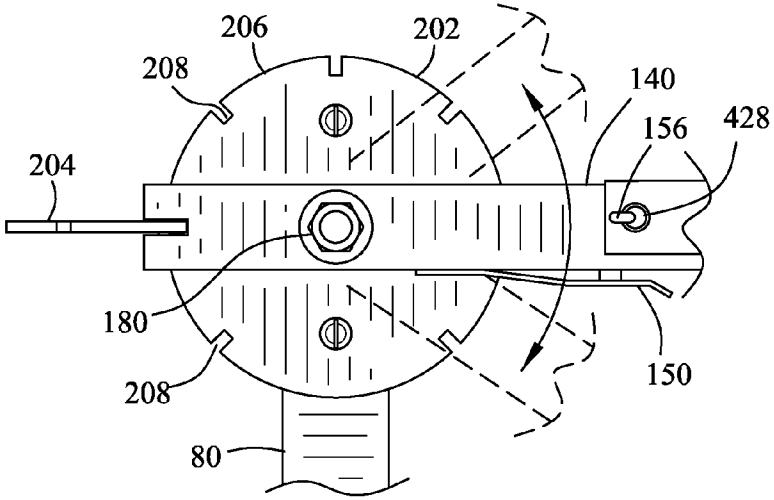
FIG. 14 is a side view of FIG. 13.
Figure 15:
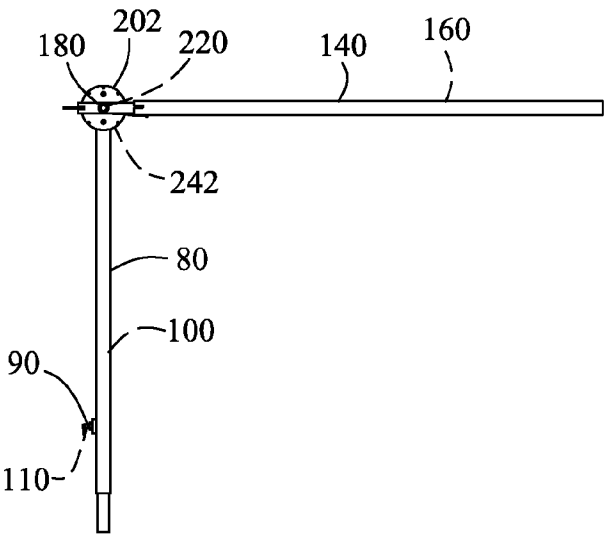
Figure 16:
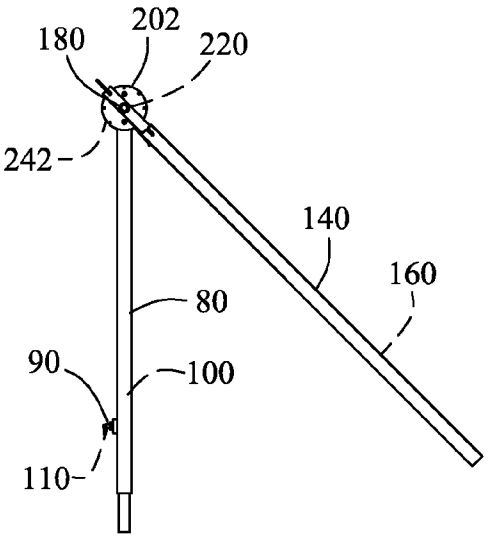
Figures 17, 18:
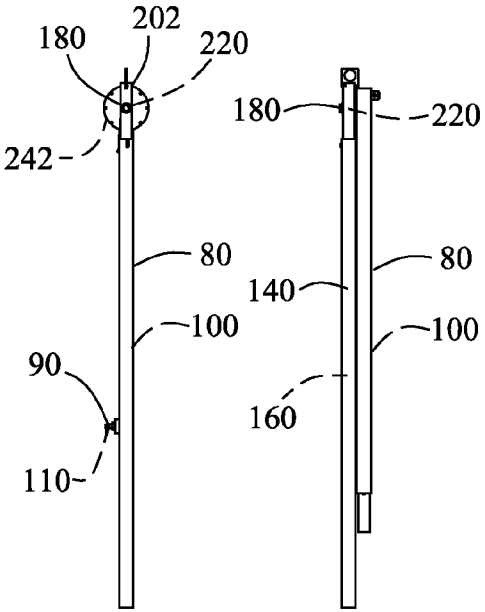
FIG. 17 is a view similar to FIG. 16 illustrating the first telescoping support member and the first telescoping cantilever member having a parallel orientation that facilitates the storage and transportation of the cantilever canopy.
FIG. 18 is a right side view of FIG. 17.

As best shown in FIG. 11, a first pivot hinge 180 pivotably couples the distal end 84 of the first telescoping support member 80 with the proximal end 142 of the first telescoping cantilever member 140. The first pivot hinge 180 provides a first angle 182 and a second angle 184 between the first telescoping support member 80 and the first telescoping cantilever member 140. The first pivot hinge 180 may comprise a bolt 186 wherein one or more washers 188 are positioned between the first telescoping support member 80 and the first telescoping cantilever member 140.

As best shown in FIGS. 11-18, a first pivot lock 200 may be utilized for terminating pivoting of the first telescoping support member 80 relative to the first telescoping cantilever member 140. The first pivot lock 200 includes a first locking plate 202 and a first locking key 204. The first locking plate 202 is coupled to the first telescoping support member 80 by one or more fasteners. Preferably the first locking plate 202 as a circular perimeter 206 wherein a first plurality of locking grooves 208 are located. The first locking key 204 is pivotably coupled to the proximal end 142 of the first telescoping cantilever member 140 by a fastener 210. The fastener 210 permits the first locking key 204 to pivot between an engagement position and a non-engagement position with the first locking plate 202. More specifically, the first locking key 204 may engage with one of the first plurality of locking grooves 208 for terminating pivoting of the first telescoping support member 80 relative to the first telescoping cantilever member 140. The first locking key 204 may be disengaged one of the first plurality of locking grooves 208 for permitting pivoting of the first telescoping support member 80 relative to the first telescoping cantilever member 140. In order to provide improved gripping of the first locking key 204, the first locking key 204 may include a handling aperture 212 wherein an individual may insert a finger or other object for facilitating the grasping of the first locking key 204. The first pivot lock 200 may further include a first biasing spring 214 for maintaining engagement of the first locking key 204 with the circular perimeter 206 absence any force applied to be first locking key 204 that overcomes the first biasing spring 214. The first biasing spring 214 also serves as a safety mechanism for automatically inserting the first locking key 204 within one of the first plurality of locking grooves 208 upon rotation of the first telescoping support member 80 relative to the first telescoping cantilever member 140.

As best shown in FIG. 9, a second pivot hinge 220 pivotably couples the distal end 104 of the second telescoping support member 100 with the proximal end 162 of the second telescoping cantilever member 160. The second pivot hinge 220 provides a third angle 222 and a fourth angle 224 between the second telescoping support member 100 and the second telescoping cantilever member 160. The second pivot hinge 220 may comprise a bolt 186 wherein one or more washers 188 are positioned between the second telescoping support member 100 and the second telescoping cantilever member 160.

As best shown in FIGS. 9 and 10, a second pivot lock 240 may be utilized for terminating pivoting of the second telescoping support member 100 relative to the second telescoping cantilever member 160. The second pivot lock 240 includes a second locking plate 242 and a second locking key 244. The second locking plate 242 is coupled to the second telescoping support member 100 by one or more fasteners. Preferably the second locking plate 242 as a circular perimeter 246 wherein a second plurality of locking grooves 248 are located. The second locking key 244 is pivotably coupled to the proximal end 162 of the second telescoping cantilever member 160 by a fastener 210. The fastener 210 permits the second locking key 244 to pivot between an engagement position and a non-engagement position with the second locking plate 242. More specifically, the second locking key 244 may engage with one of the second plurality of locking grooves 248 for terminating pivoting of the second telescoping support member 100 relative to the second telescoping cantilever member 160. The second locking key 244 may be disengaged one of the second plurality of locking grooves 248 for permitting pivoting of the second telescoping support member 100 relative to the second telescoping cantilever member 160. In order to provide improved gripping of the second locking key 244, the second locking key 244 may include a second handling aperture 252 wherein an individual may insert a finger or other object for facilitating the grasping of the second locking key 244. The second pivot lock 240 may further include a second biasing spring 254 for maintaining engagement of the second locking key 244 with the circular perimeter 246 absence any force applied to be second locking key 244 that overcomes the second biasing spring 254. The second biasing spring 254 also serves as a safety mechanism for automatically inserting the second locking key 244 within one of the second plurality of locking grooves 248 upon rotation of the second telescoping support member 100 relative to the second telescoping cantilever member 160.

Figure 2:
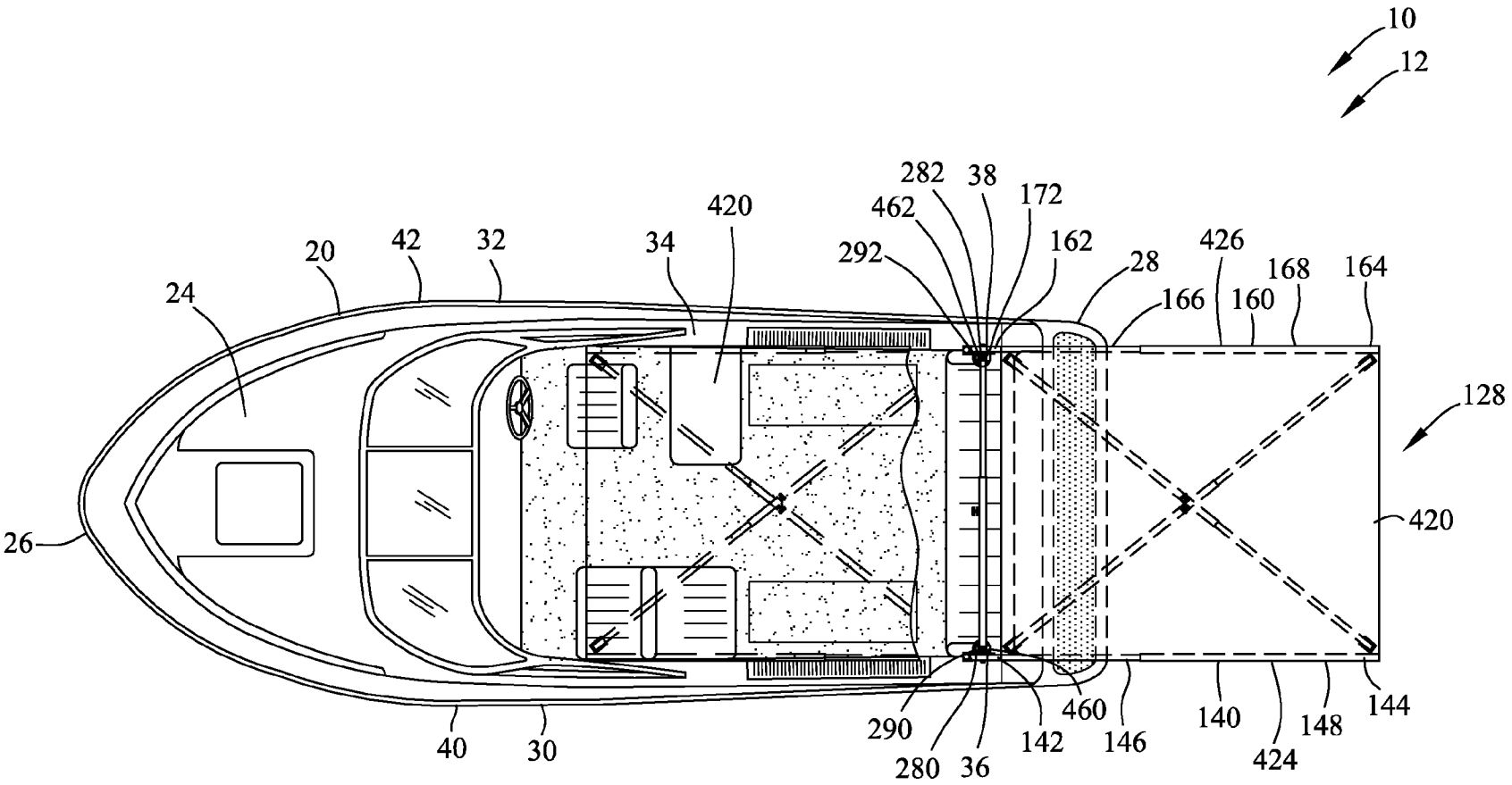
FIG. 2 is a top view of FIG. 1.

As best shown in FIG. 2, a first anchor 280 couples the proximal end 82 of the first telescoping support member 80 to the surface 12. A second anchor 282 couples the proximal end 102 of the second telescoping support member 100 to the surface 12.

As shown in FIGS. 2, 19, 24 and 25, the first anchor 280 may include a first fishing rod plug 290 for inserting into the first fishing rod holder 36. The second anchor 282 may include a second fishing rod plug 292 for inserting into a second fishing rod holder 38. The first fishing rod plug 290 and the second fishing rod plug 292 may further include a rubber layer 284 for preventing displacement of the first fishing rod plug 290 and the second fishing rod plug 292 relative to the first fishing rod holder 36 and the second fishing rod holder 38 respectively.

Figures 19, 20, 21:
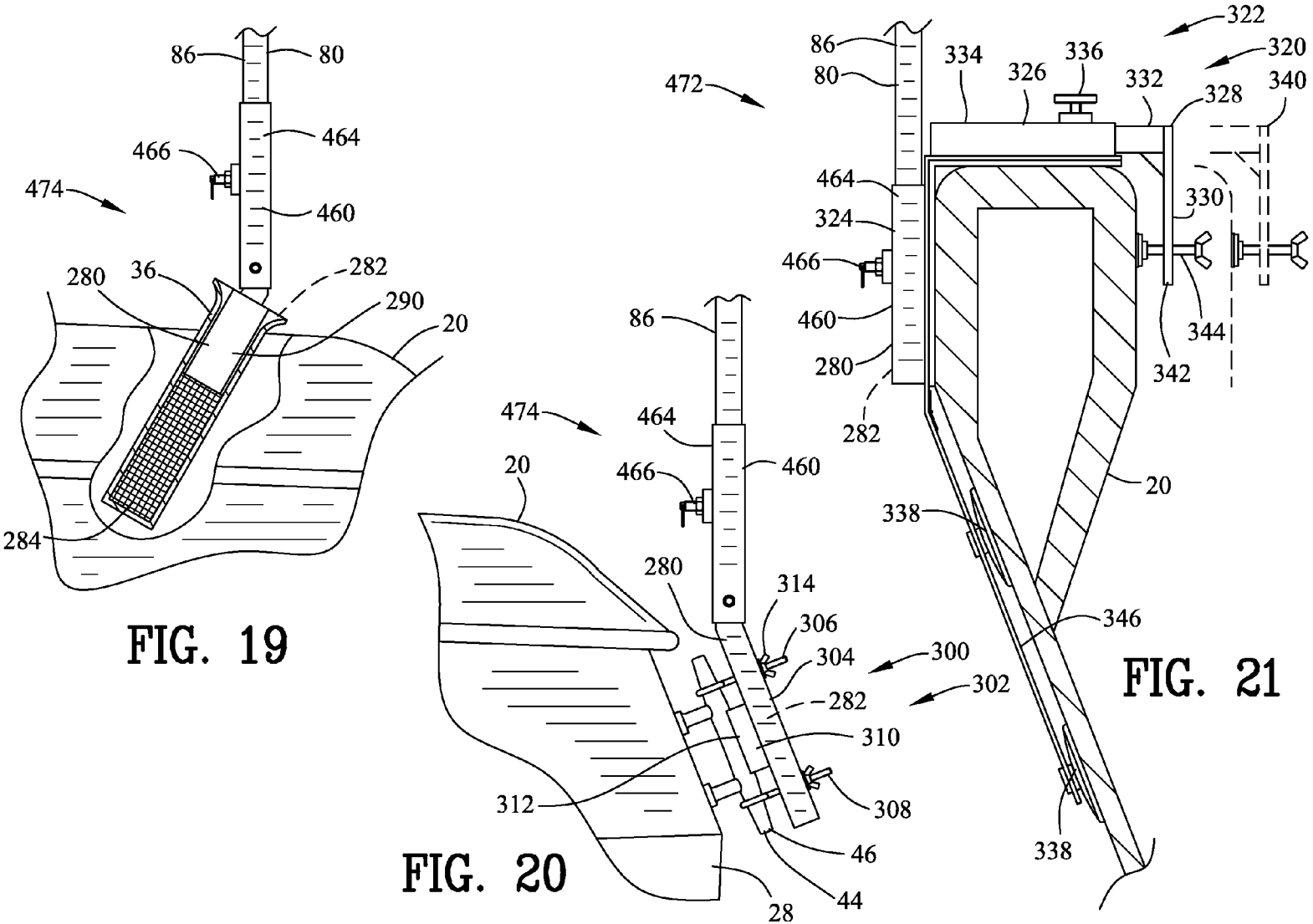
FIG. 19 is an enlarged portion of FIG. 1 illustrating a first anchor including a first fishing rod plug for inserting into a first fishing rod holder.
FIG. 20 is an enlarged portion of FIG. 1 illustrating the first anchor including a first cleat clamp for engaging a first cleat that is secured to the transom of a boat.
FIG. 21 is a sectional view of a first hull side receiving the first anchor including a first boat hull clamp.
Figure 26:
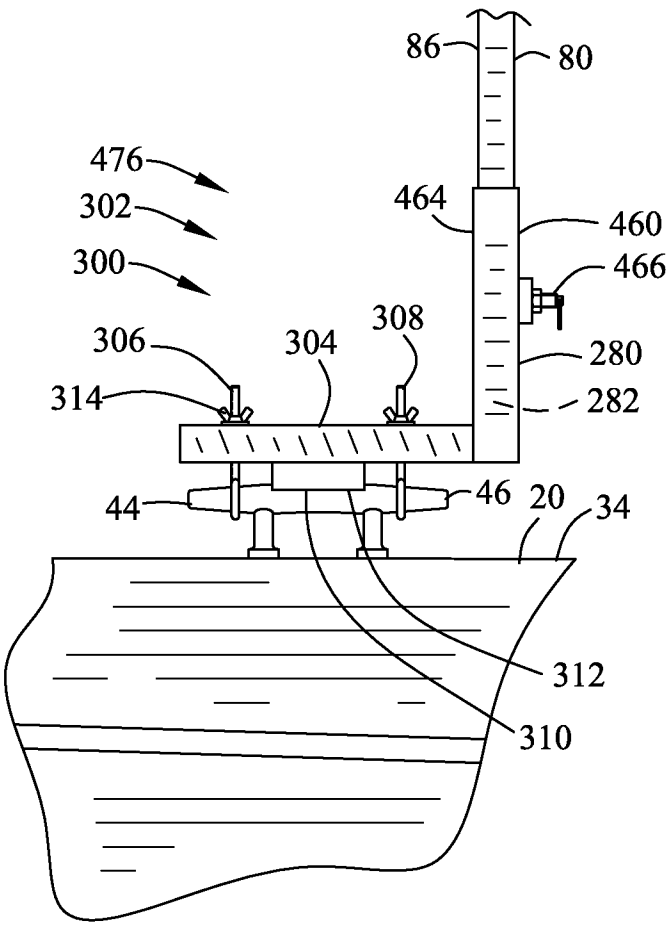
FIG. 26 is a side view of a first non-linear anchor couple utilized with a first cleat clamp for engaging a first cleat that is secured to the gunnel of a boat.

Alternatively, as shown in FIGS. 20 and 26, the first anchor 280 may include a first cleat clamp 300 for engaging with the first cleat 44. The second anchor 282 may include a second cleat clamp 302 for engaging with a second cleat 46. The first cleat clamp 300 and the second cleat clamp 302 may comprise a cleat clamping frame 304 receiving a first eye bolt 306 and a second eye bolt 308. The first eye bolt 306 and the second eye bolt 308 engage the end portions of the first cleat 44 and the second cleat 46. A cleat mounting bracket 310 having a V-shaped surface 312 is secured to the cleat clamping frame 304. The V-shaped surface 312 engages the top surface of the first cleat 44 and the second cleat 46. A threaded fastener 314 engages the first eye bolt 306 and the second eye bolt 308 for compressing the first cleat 44 and the second cleat 46 against the V-shaped bracket 310. The V-shaped surface 312 assists in preventing rotation of the first cleat clamp 300, and the second cleat clamp 302. Relative to the first cleat 44 and the second cleat 46 respectively.

As shown in FIG. 21, the first anchor 280 may include a first boat hull clamp 320 for engaging a first hull side 30. The second anchor 282 may include a second boat hull clamp 322 for engaging a second hull side 32. The first boat hull clamp 320 and the second boat hull clamp 322 have an outer hull frame 324, a gunwale telescoping frame 326 and an inner hull frame 328 for defining a C-clamp 330.

The gunwale telescoping frame 326 is defined by a primary member 332 and a secondary member 334. The primary member 332 has a smaller cross-sectional area then the secondary member 334 for permitting the primary member 332 to slidably engage within the secondary member 334. A threaded gunwale pin 336 traverses the primary member 332 and the secondary member 334 for terminating displacement between the primary member 332 and the secondary member 334. The threaded gunwale pin 336 maybe withdrawn from the secondary member 334 for permitting the displacement between the primary member 332 and the secondary member 334 for defining a first boat clamp length 340 and a second boat clamp length 342. The gunwale telescoping frame 326 is illustrated as having a square cross-sectional geometry for preventing rotation of the primary member 332 relative to the secondary member 334, however, the cross-sectional geometry of the gunwale telescoping frame 326 may include other geometric shapes.

The inner hull frame 328 of the first hull clamp 320 and the second hull clamp 322 includes a compression tool 344 for applying a compressive force to the first hull side 30 and the second hull side 32. The outer hull frame 324 of the first boat bull clamp 320 and the second boat hull clamp 322 may further include a extending mounting bracket 346 having one or more suction cups 338 that may be secured against the hull 22.

As shown in FIG. 22, the first anchor 280 may include a first truck bed clamp 350 for engaging a first truck bed side 360. The second anchor 282 may include a second truck bed clamp 352 for engaging a second truck bed side 362. The first truck bed clamp 350 and the second truck bed clamp 352 include a jamb frame 370 and a lock shaft strap 372. The lock shaft strap 372 encircles the tailgate locking shaft 60 for coupling the first anchor 280 and the second anchor 282 to a truck bed 50. The jamb frame 370 of the first truck bed clamp 350 and the second truck bed clamp 352 includes a compression tool 374 for applying a compressive force to the truck bed 50 and compressing the lock shaft strap 372 of the first anchor 280 and second anchor 282 against the tailgate locking shaft 60.

Figure 23:
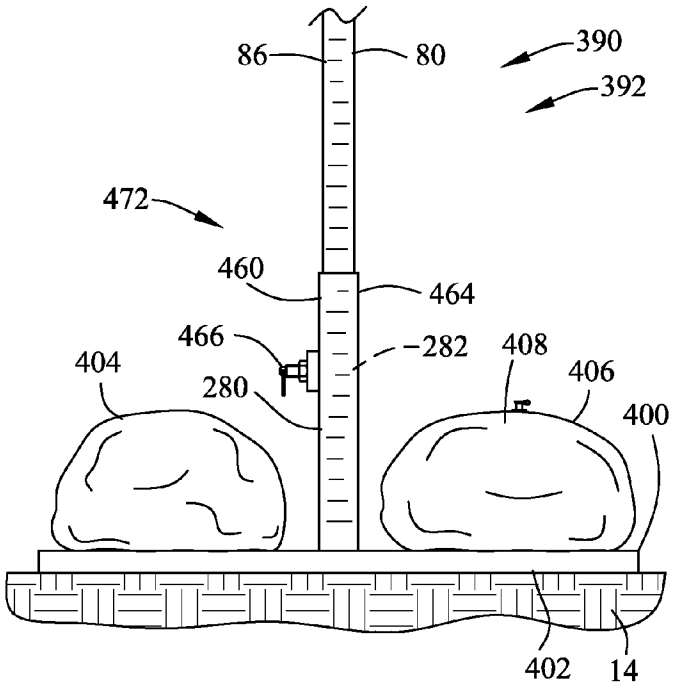
FIG. 23 is a side view of a first basic platform receiving the first anchor including a first solid weight and a first bladder.

As shown in FIG. 23, the first anchor 280 may include a first base platform 390 for positioning adjacent to the surface 12 or ground 14. The second anchor 282 may include a second base platform 392 for positioning adjacent to the surface 12. The first base platform 390 and the second base platform 392 have an upper surface 400 and a lower surface 402. The upper surface 400 of the first anchor 280 and the second anchor 282 may receive one or more solid weight 404 for compressing the lower surface 402 of the first anchor 280 and the second anchor 282 against the surface 12 or ground 14.

Alternatively, the upper surface 400 of the first anchor 280 and the second anchor 282 may receive a bladder 406 for receiving a liquid 408. The bladder 406 compresses the lower surface 402 of the first anchor 280 and the second anchor 282 against the surface 12.

Figure 3:
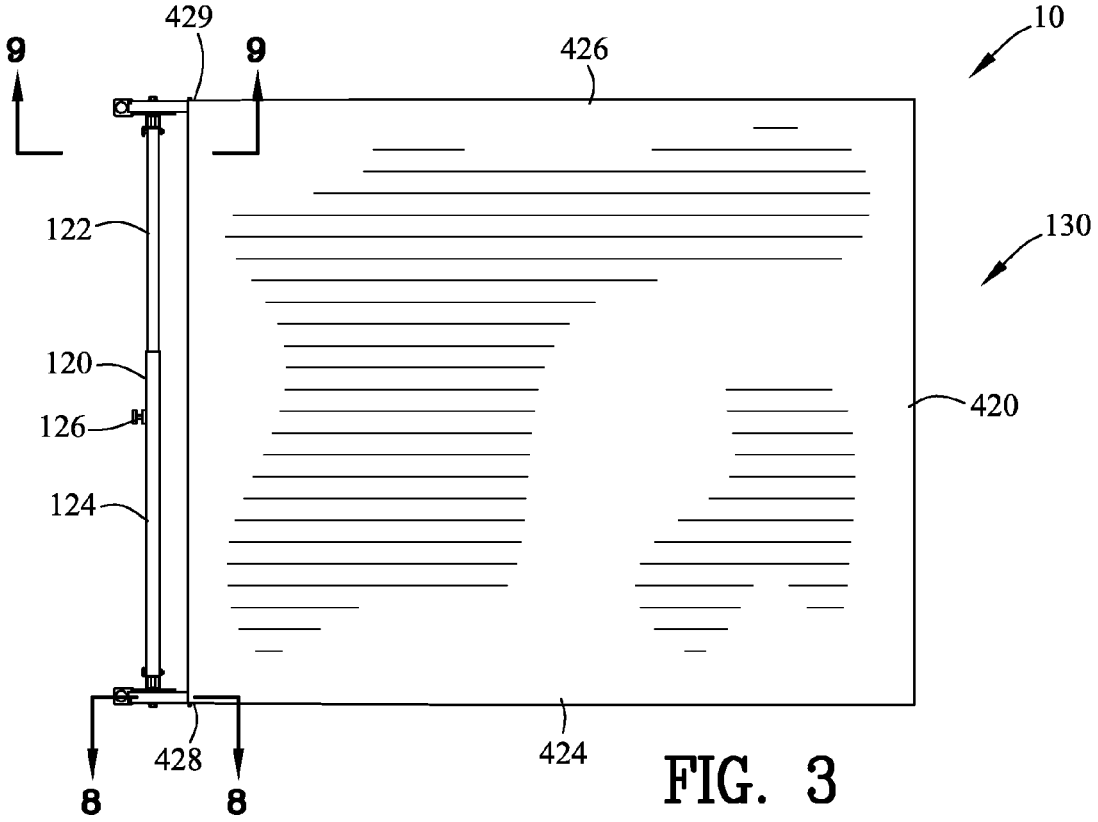
FIG. 3 is an enlarged view of the cantilever canopy as shown in FIG. 2.

As shown in FIGS. 2, 3, and 6, a screen 420 extends between the first telescoping cantilever member 140 and the second telescoping cantilever member 160 for providing shelter 422 under the screen 420. The screen 420 may be constructed from a polymeric material, a cotton material or other flexible layer material. The screen 420 maybe slidably engage with the first telescoping cantilever member 140 and the second telescoping cantilever member 160 for permitting the extension and retraction of the first telescoping cantilever member 140 and the second telescoping cantilever member 160. More specifically, the screen 420 may include a first screen channel 424 surrounding the first telescoping cantilever member 140 and a second screen channel 426 surrounding the second telescoping cantilever number 160. The first screen channel 424 and the second screen channel 426 may be created by overlapping the screen material 420 along the sides and securing the ends by sewing, adhesive or other fastening means.

As best shown FIGS. 6, 9, 11-14 and 24, the screen 420 may include a first eyelet 428 for engaging a first screen clip 156 mounted on the first telescoping cantilever member 140. Similarly, the screen 420 may include a second eyelet 429 for engaging a second screen clip 172 mounted on the second telescoping cantilever member 160. The coupling the screen 420 utilizing the first eyelet 428 and the second eyelet 429 prevents the rear edge of the screen 420 from being displaced away from the first pivot hinge 180 and the second pivot hinge 220.

The screen 420 may further include a first pocket 430, a second pocket 432, a third pocket 434 and a fourth pocket 436. The first pocket 430 is positioned adjacent to the proximal end 142 of the first telescoping cantilever member 140. The second pocket 432 is positioned adjacent to the distal end 144 of the first telescoping cantilever member 140. The third pocket 434 is positioned adjacent to the proximal end 162 of the second telescoping cantilever member 160. The fourth pocket 436 is positioned adjacent to the distal end 164 of the second telescoping cantilever member 160.

Figure 24:
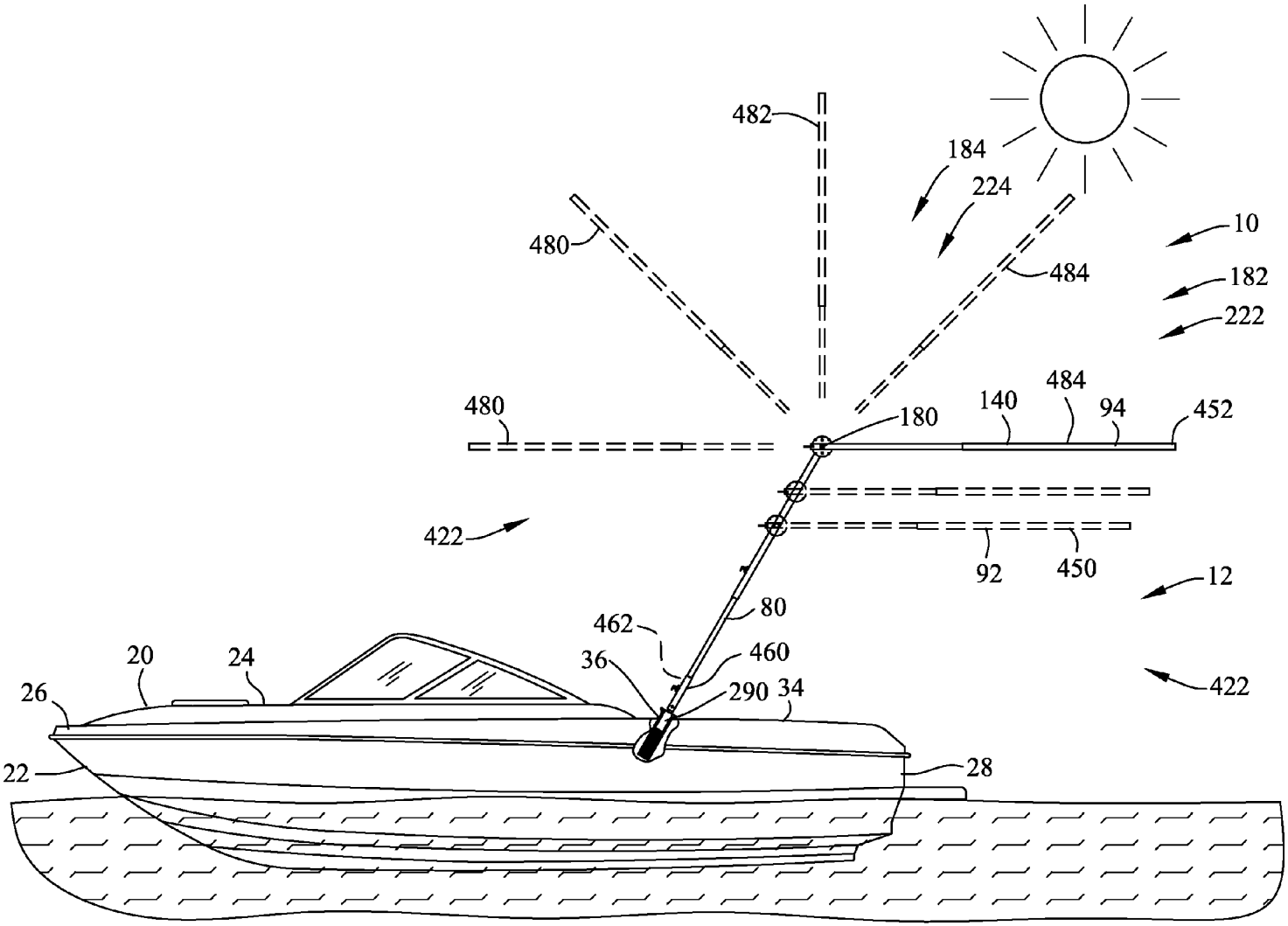
FIG. 24 is a view similar to FIG. 1 illustrating a first linear anchor couple for positioning the screen in a greater distance relative to the first fishing rod holder.

As best shown in FIG. 24, a first telescoping rib member 440 is inserted into the first pocket 430 and the fourth pocket 436 for preventing sagging of the screen 420 and preventing displacement of the first telescoping cantilever member 140 relative to the second telescoping cantilever member 160. A second telescoping rib member 442 is inserted into the second pocket 432 and the third pocket 434 for preventing sagging of the screen 420 and preventing displacement of the first telescoping cantilever member 140 relative to the second telescoping cantilever member 160.

The first telescoping rib member 440 and the second telescoping rib member 442 are defined by a primary member 444 and a secondary member 446. The primary member 444 has a smaller cross-sectional area then the secondary member 446 for permitting the primary member 444 to slidably engage within the secondary member 446. A threaded rib pin 448 traverses the primary member 444 and the secondary member 446 for terminating displacement between the primary member 444 and the secondary member 446. The threaded rib pin 448 maybe withdrawn from the secondary member 124 for permitting displacement between the primary member 122 and the secondary member 446 for defining the first screen length 450 and the second screen length 452. The second screen length are illustrated as having a square cross-sectional geometry for preventing rotation of the primary member 444 relative to the secondary member 446, however, the cross-sectional geometry of the first telescoping rib member 440 and the second telescoping rib member 442 may include other geometric shapes.

The first telescoping rib member 440 and the second telescoping rib member 442 define a generally X-shape 454. The intersection between the first telescoping rib member 440 and the second telescoping rib member 442 may have a coupling clip 456 for preventing the displacement of the first telescoping rib member 440 relative to the second telescoping rib member 442. The first telescoping rib member 440 and the second telescoping rib member 442 further prevent the contraction of the first telescoping cantilever member 140 and the second telescoping cantilever member 160.

As best shown in FIGS. 1, 2, 9, 12, 14-18 and 24, first pivot hinge 180 and the second pivot hinge 220 are capable of positioning the screen 420 in a forward facing orientation, 480, a vertical facing orientation 482 or a rear facing orientation 484. More specifically, the first pivot hinge 180 and the second pivot hinge 220 enable the first telescoping cantilever member 140 and the second telescoping cantilever member 160 to rotate in almost a 360° range. In application, as shown in FIGS. 1, 2 and 24, a forward facing orientation 480 could be utilized to provide shelter for the boat 20. In a rear facing orientation 484, the screen could be utilized to provide shelter for individuals swimming adjacent to the stern 28.

As best shown in FIGS. 1 and 19-24, the first anchor 280 may be removably coupled to the proximal end 82 of the first telescoping support member 80 by utilizing a first support couple 460. Similarly, the second anchor 282 may be removably coupled to the proximal end 102 of the second telescoping support member 100 by utilizing a second support couple 462. The first support couple 460 and the second support couple 462 include a couple frame 464. The couple frame 464 has a greater cross-sectional area then the primary members 86 and 106 for permitting the primary members 86 and 106 to slidably engage within the couple frame 464. A couple pin 466 traverses the couple frame 464 and the primary members 86 and 106 for securing the couple frame 464 with the first telescoping support member 80 and the second telescoping support member 100. The couple pin 466 maybe withdrawn from the primary members 86 and 106 for permitting the removal of the first anchor 280 from the first telescoping support member 80 and the removal of the second anchor 282 from the second telescoping supporting member 100. The couple frame 464 is illustrated as having a square cross-sectional geometry for preventing rotation of the primary members 86 and 106 relative to the couple frame 464, however, the cross-sectional geometry of the couple frame 464 may include other geometric shapes.

As shown in FIGS. 1, 19, 20, 24-26, a couple frame 464 may have an angled portion 470 or a non-angled portion 472 for positioning the screen 420 in various positions relative to the first anchor 280 and the second anchor 282. For example, as shown in FIGS. 1, 19 and 20, the first anchor 280 and the second anchor 282 are positioned within the first fishing rod holder 36 and the second fishing rod holder 38 respectively, wherein the first fishing rod holder 36 and the second fishing rod holder 38 are positioned adjacent to the stern 28. In this configuration, an obtuse angle 474 is between the first anchor 280 and the second anchor 282 and the first telescoping support member 80 and the second telescoping support member 100 respectively. The obtuse angle 474 produces a generally vertical first telescoping support member 80 and second telescoping support member 100 for positioning the screen 420 in a generally adjacent position relative to the stern 28.

Figure 25:
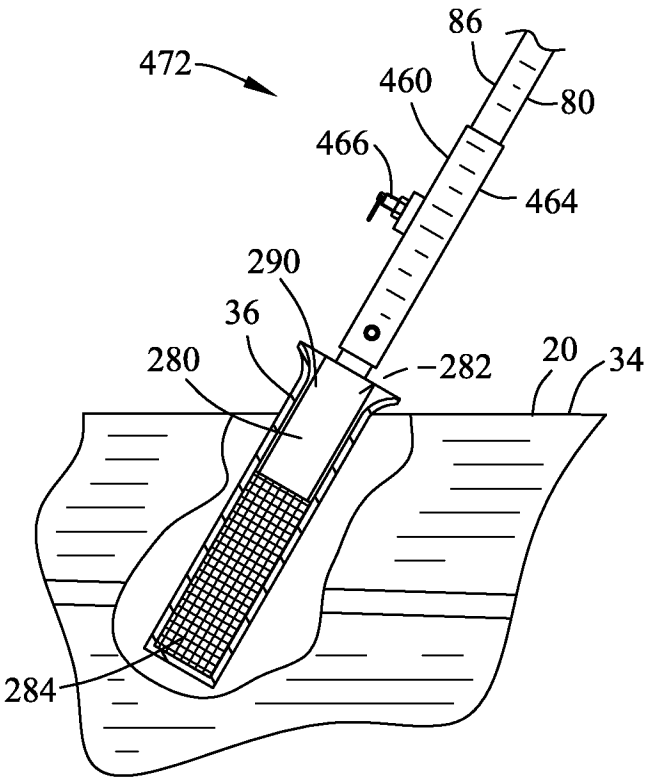
FIG. 25 is an enlarged portion of FIG. 24.
Figure 27:
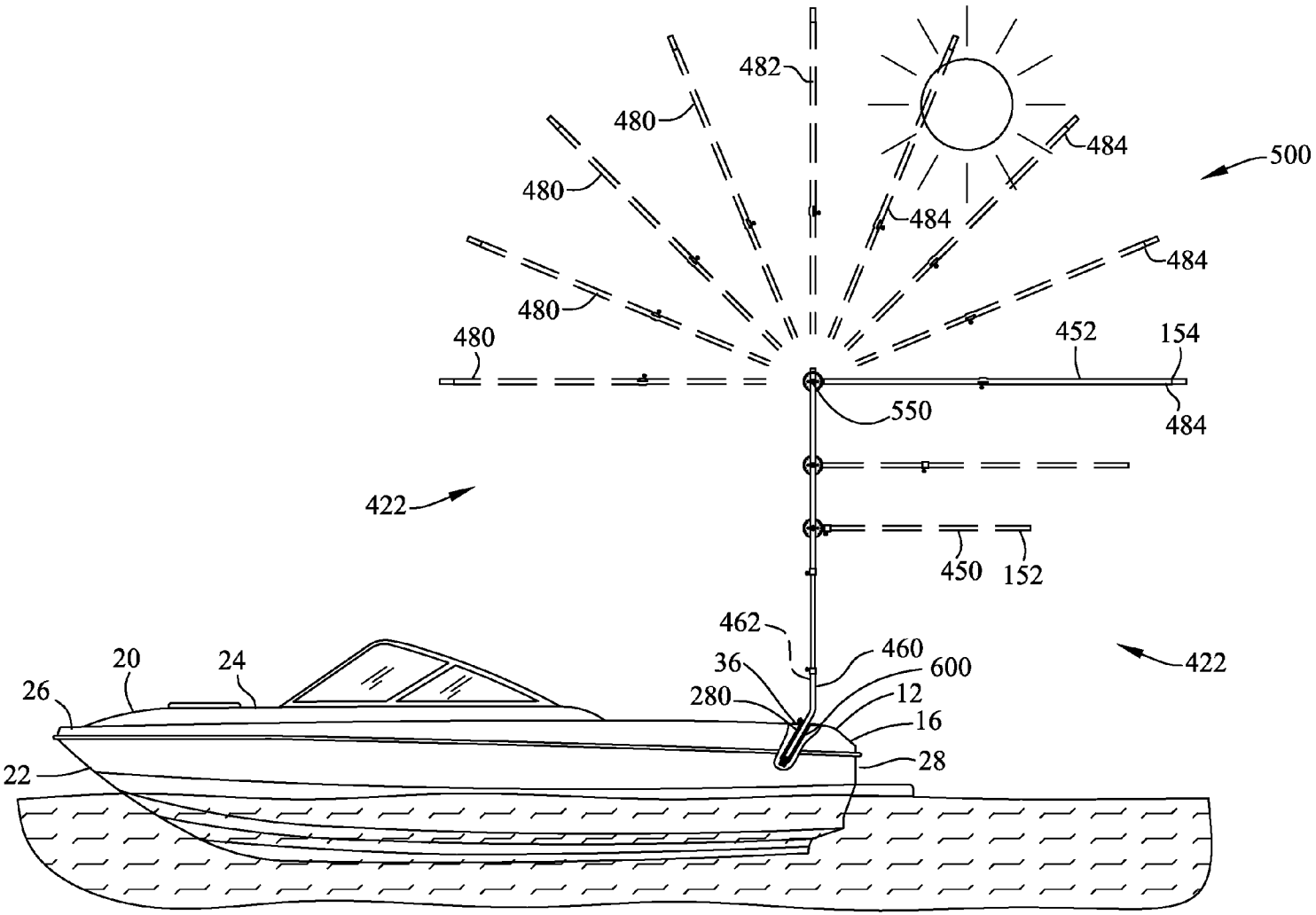
FIG. 27 is a side view of a second embodiment of a cantilever canopy for extending over a surface of the present invention.
Figure 28:
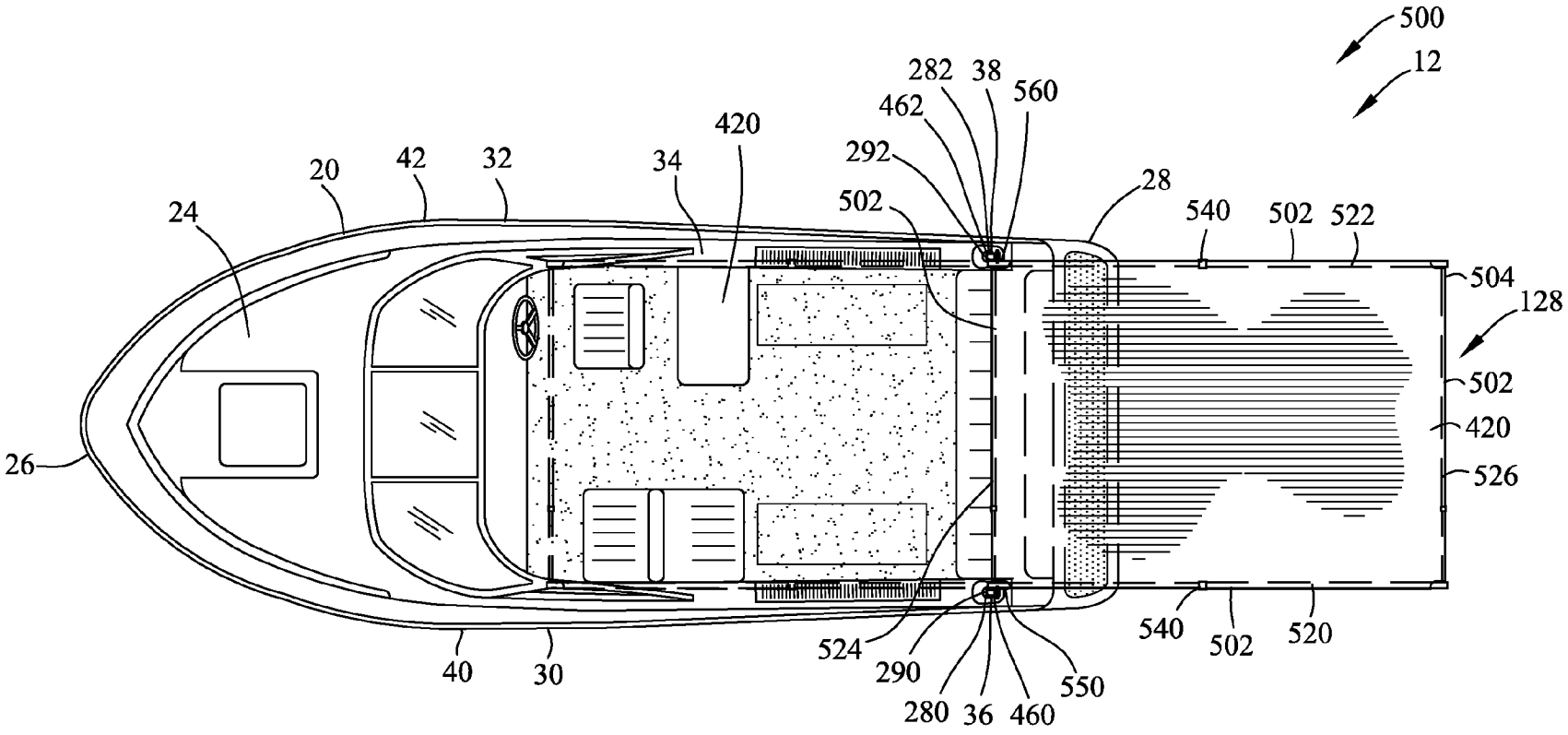
FIG. 28 is a top view of FIG. 27.
Figure 32:
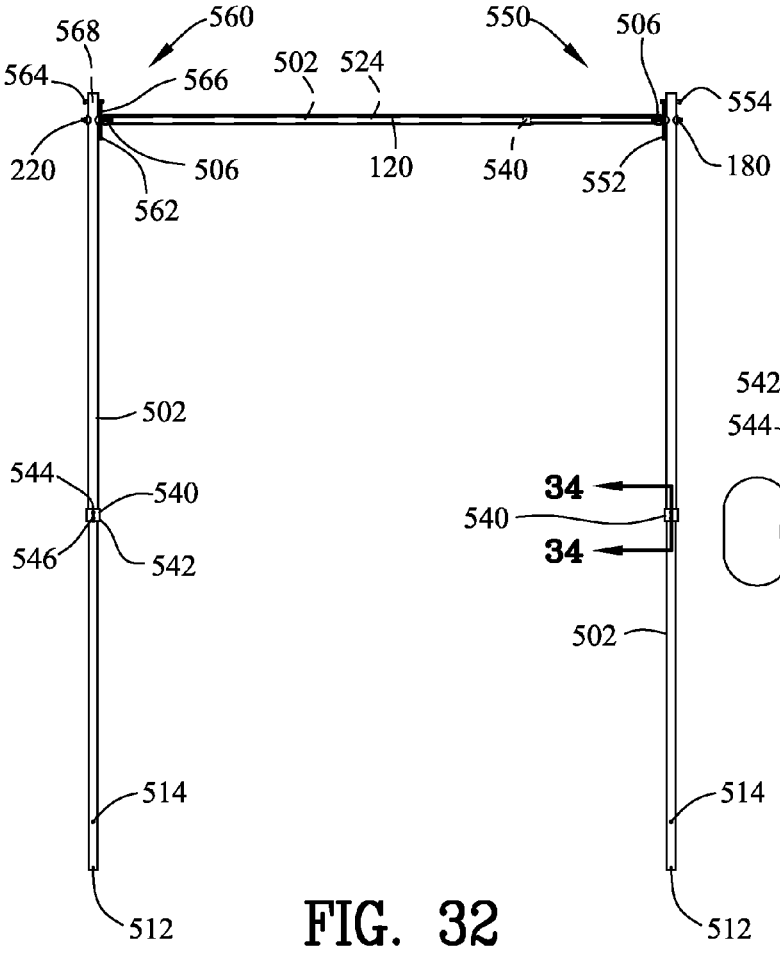
FIG. 32 is a sectional view along line 32-32 in FIG. 30 illustrating the first telescoping support member and the second telescoping support member providing a first canopy height and a second canopy height.
Figure 34:
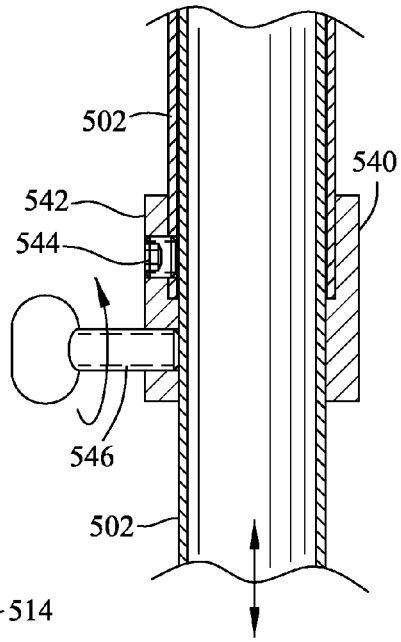
FIG. 34 is a sectional view along line 34-34 in FIG. 32 illustrating the first telescoping support member including a first support member clamp for rigidly securing the primary member relative to the secondary member of the first telescoping support member.
Figure 33:
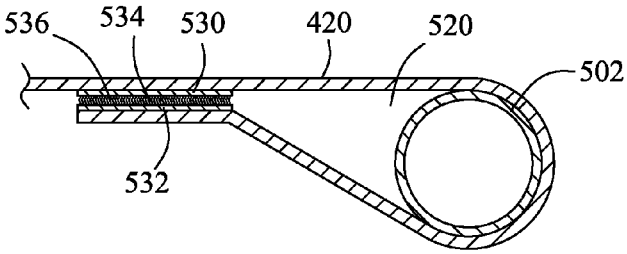
FIG. 33 is a sectional view along line 33-33 in FIG. 29 illustrating the screen including first elongated coupling band encircling the first telescoping cantilever member wherein an upper fastener and a lower fastener engage for maintaining the first elongated coupling band adjacent to the screen.
Figure 35:
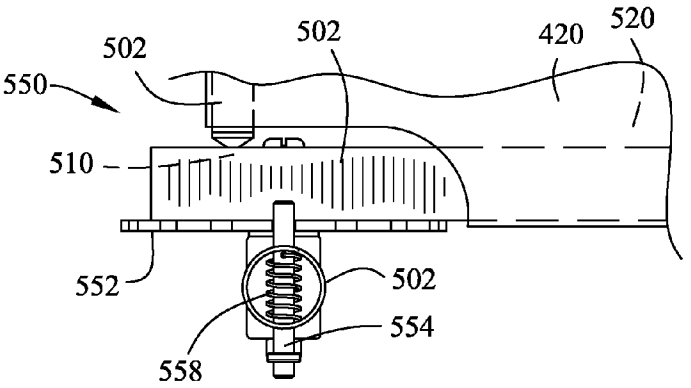
FIG. 35 is an enlarged portion of FIG. 29 illustrating a first locking pin engaged with the first locking plate for terminating pivoting of the first telescoping support member relative to the first telescoping cantilever member.
Figure 36:
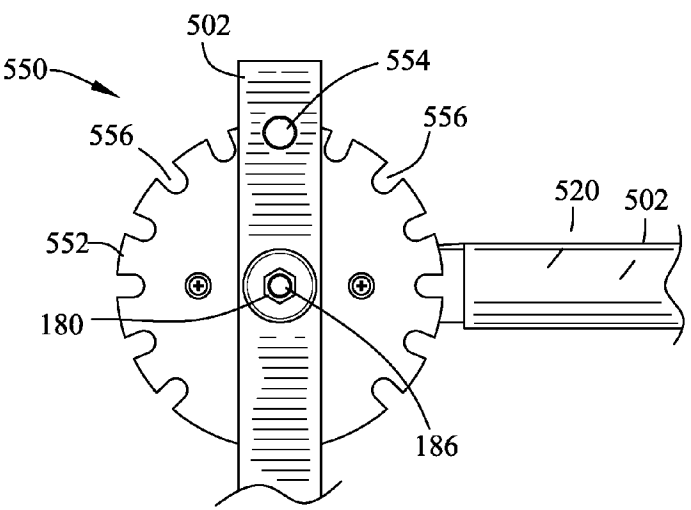
FIG. 36 is a side view of FIG. 35.
Figure 37:
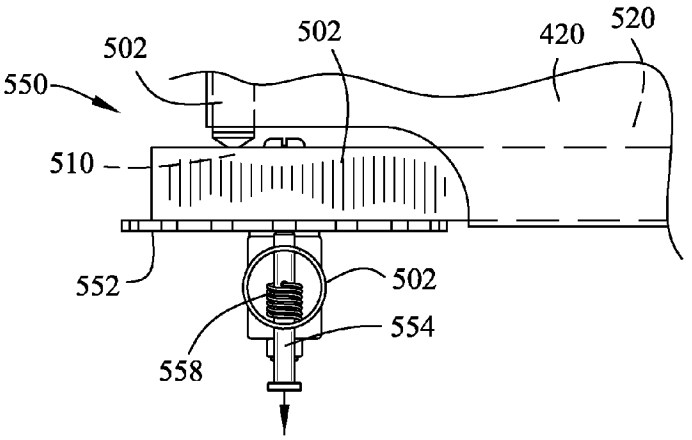
FIG. 37 is a view similar to FIG. 35 illustrating a first locking pin disengaged with the first locking plate for permitting pivoting of the first telescoping support member relative to the first telescoping cantilever member.
Figure 38:
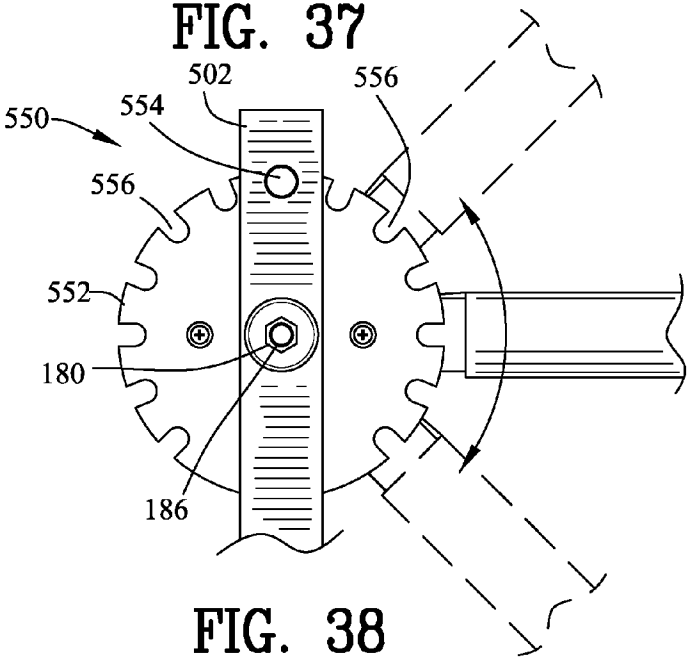
FIG. 38 is a side view of FIG. 37 illustrating the pivoting of the first telescoping support member relative to the first telescoping cantilever member.
Figure 41:
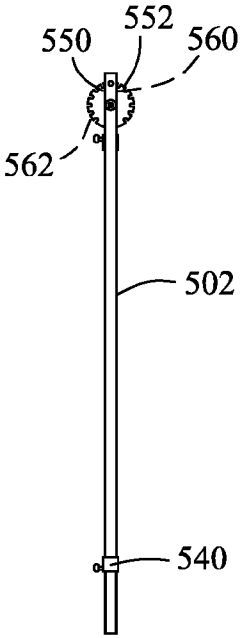
FIG. 41 is a view similar to FIG. 40 illustrating the first telescoping support member and the first telescoping cantilever member having a parallel orientation that facilitates the storage and transportation of the cantilever canopy.
Figure 40:
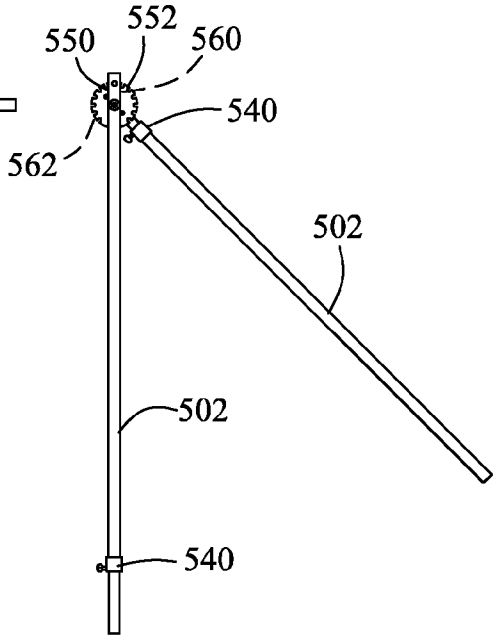
Figure 39:
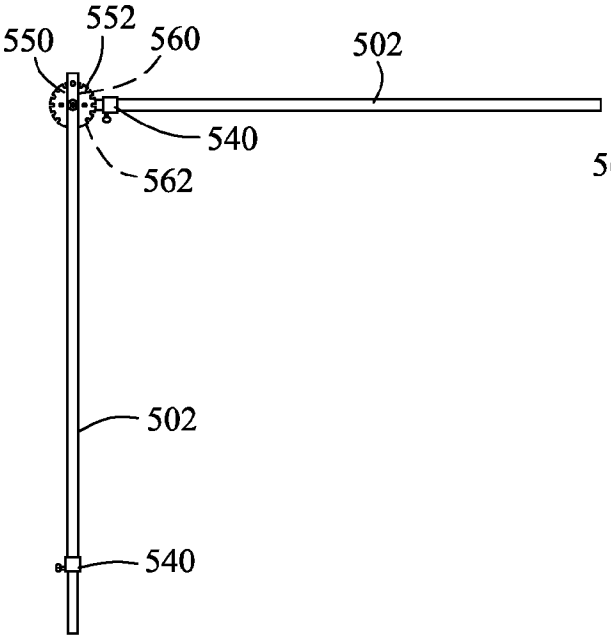

As shown in FIGS. 24 and 25, the first anchor 280 and the second anchor 282 are positioned within the first fishing rod holder 36 and the second fishing rod holder 38 respectively, where in the first fishing rod holder 36 and the second fishing rod holder 38 are positioned generally equidistant in relation to the bow 26 and the stern 28. In this configuration, the first support couple 460 and the second support couple 462 have the non-angled portion 472 between the first anchor 280 and the second anchor 282 and the first telescoping support member 80 and the second telescoping support member 100 respectively. The non-angled portion 472 increases the distance of the screen 420 from the first anchor 280 and the second anchor 282.

As shown in FIG. 26, the first anchor 280 and the second anchor 282 are engaging a first cleat 44 and a second cleat 46 respectively. In this configuration, the first support couple 460 and the second support couple 462 have the right angle portion 476 between the first anchor 280 and the second anchor 282 and the first telescoping support member 80 and the second telescoping support member 100 respectively. The right angle portion 476 positions the first telescoping support member 80 and the second telescoping support member 100 in a generally vertical orientation, wherein the first anchor 280 and the second anchor 282 are in a generally horizontal position.

FIGS. 27-42A illustrate a second embodiment of the cantilever canopy 500. In FIGS. 27-42A the first telescoping support member 80, the second telescoping support member 100, the telescoping coupling member 120, the first telescoping cantilever member 140, the second telescoping cantilever member 160 may include a cylindrical rod 502 constructed of aluminum, polymeric material or other rigid material. The second embodiment 500 further includes a second telescoping coupling member 504 engaging between the distal end 144 of the first telescoping cantilever member 140 and the distal end 164 of the second telescoping cantilever member 160. As best shown in FIG. 31, the telescoping coupling member 120 and the second telescoping coupling member 504 may include terminal ends that include a coupling member pin 506. The first telescoping cantilever member 140 and the second telescoping cantilever member 160 include a support aperture 508 for receiving the coupling member pin 506. The engagement between the support aperture 508 and the coupling member pin 506 formed a pin and aperture engagement 510 for coupling the first telescoping cantilever member 140 with the second telescoping cantilever member 160.

The second embodiment of the cantilever canopy 500 further includes the screen 420 having a first elongated coupling band 520, a second elongated coupling band 522, a third elongated coupling band 524 and a fourth elongated coupling band 526. The first elongated coupling band 520 encircles the first telescoping cantilever lever member 140. The second elongated coupling band 522 encircles the second telescoping cantilever member 160. The third elongated coupling band 524 encircles the telescoping coupling member 120. The fourth elongated coupling band 526 encircles the second telescoping coupling member 504. Each of the elongated coupling bands 520, 522, 524 and 526 are fastened to the underside of the screen 420 by an upper fastener 530 and a lower fastener 532. The fasteners 530 and 532 may include hook and loop strips 534, snaps 536 or other fastening means.

The engagement of each of the elongated coupling bands 520, 522, 524 and 526 compresses the first telescoping cantilever member 140 and the second telescoping cantilever member 160 against the telescoping coupling member 120 and the second telescoping coupling member 504.

The length of the telescoping coupling member 120 and the second telescoping coupling member 504 may be varied by the telescoping movement between a primary member 122 and a secondary member 124. A coupling member clamp 540 including a cylindrical body 542 is coupled to the primary member 122 by a set screw 544. A threaded screw 546 threadably engages through the cylindrical body 542 and compresses against the secondary member 124 for terminating displacement between the primary, member 122 and the secondary, member 124.

Similarly, the length of the first telescoping support member 80 and the second telescoping support member 100 may be varied by the telescoping movement between the primary member 86 and 106 and the secondary member 88 and 108. An additional cylindrical body 542 of the coupling member clamp 540 is coupled to the primary member 86 and 106 by the set screw 544. The threaded screw 546 threadably engages into the cylindrical body 542 and compresses against the secondary member 88 and 108 for terminating displacement between the primary member 86 and 106 and the secondary member 88 and 108.

As best shown in FIGS. 35-42, a first pivot lock 550 includes a first locking plate 552 and a first locking pin 554. The first locking plate 552 is coupled to the first telescoping cantilever member 140. The first locking plate 552 includes a first plurality of locking grooves 556. The first locking pin 554 traversing the distal end 84 of the first telescoping support member 80.

The first locking pin 554 engages one of the first plurality of locking grooves 556 for terminating pivoting of the first telescoping support member 80 relative to the first telescoping cantilever member 140. The first locking pin 554 disengages one of the first plurality of locking grooves 556 for permitting pivoting of the first telescoping support member 80 relative to the first telescoping cantilever member 140. A first pin spring 558 is positioned around the first locking pin 554 and within the first telescoping support member 80. The first pin spring 558 positions the first locking pin 554 into engagement with the first locking plate 552 once a retraction force is removed from the first locking pin 554.

A second pivot lock 560 includes a second locking plate 562 and a second locking pin 564. The second locking plate 562 is coupled to the second telescoping cantilever member 160. The second locking plate 562 includes a second plurality of locking grooves 566. The second locking pin 564 traversing the distal end 104 of the second telescoping support member 100.

The second locking pin 564 engages one of the second plurality of locking grooves 566 for terminating pivoting of the second telescoping support member 100 relative to the second telescoping cantilever member 160. The second locking pin 564 disengages one of the second plurality of locking grooves 566 for permitting pivoting of the second telescoping support member 100 relative to the second telescoping cantilever member 160. A second pin spring 568 is positioned around the second locking pin 564 and within the second telescoping support member 100. The second pin spring 568 positions the second locking pin 564 into engagement with the second locking plate 562 once a retraction force is removed from the second locking pin 564.

Figure 42:
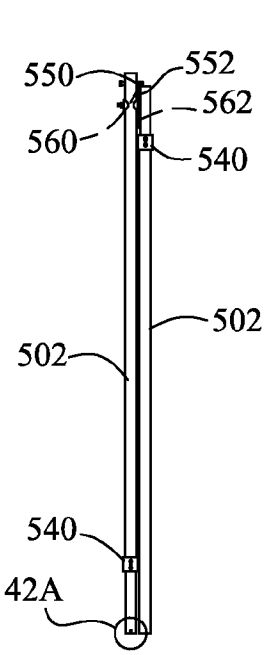
FIG. 42 is a right side view of FIG. 41.
Figure 42A:
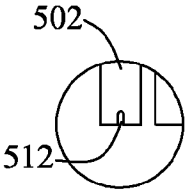
FIG. 42A is an enlarged portion of FIG. 42 illustrating the proximal end of the first telescoping support member including a first mounting groove for engaging a fishing rod stopping pin for preventing rotation of the first telescoping support member relative to the fishing rod holder.
Figure 45:
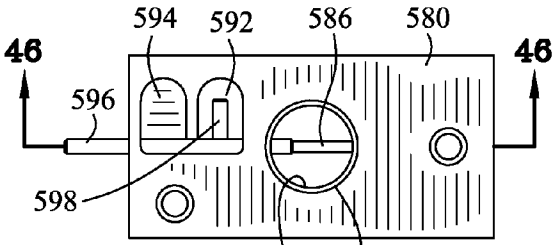
FIG. 45 is a view similar to FIG. 43 illustrating the first mounting pin in an extended position.
Figure 46:
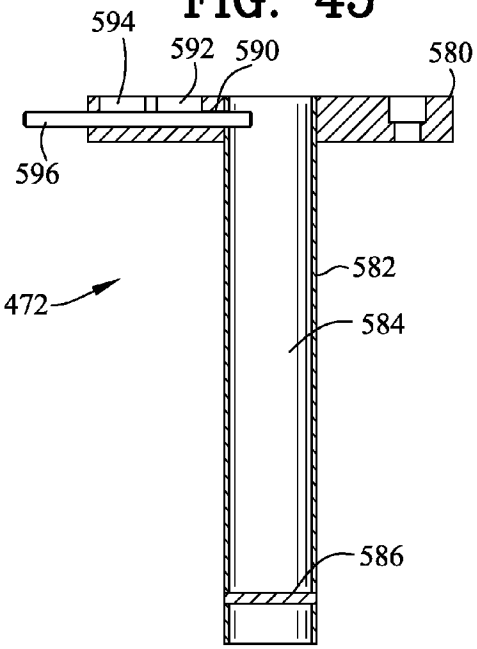
FIG. 46 is a sectional view along line 46-46 in FIG. 45.
Figure 43:
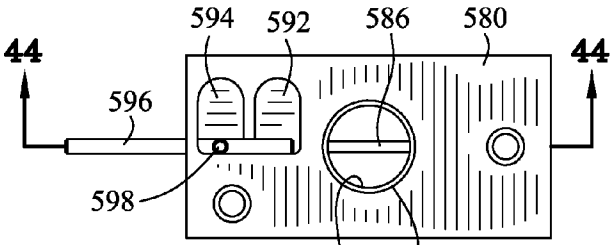
FIG. 43 is a top view of a first anchor wherein a first mounting pin is in a retracted position.
Figure 44:
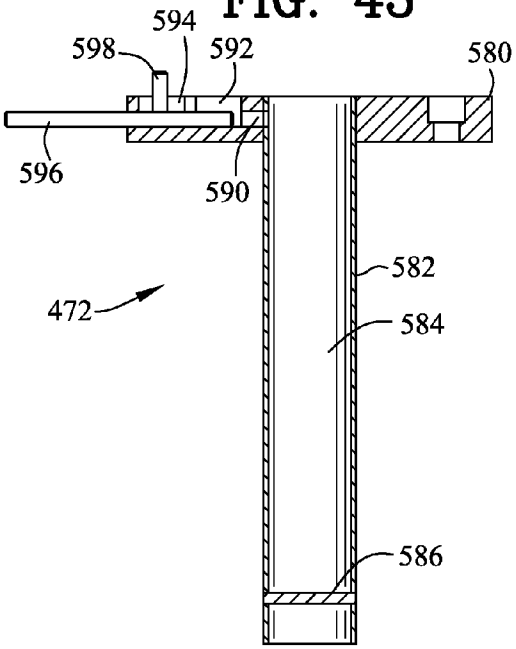
FIG. 44 is a sectional view along line 44-44 in FIG. 43 illustrating the first anchor including a first mounting plate and a first mounting cylinder having a 90° orientation.
Figure 49:
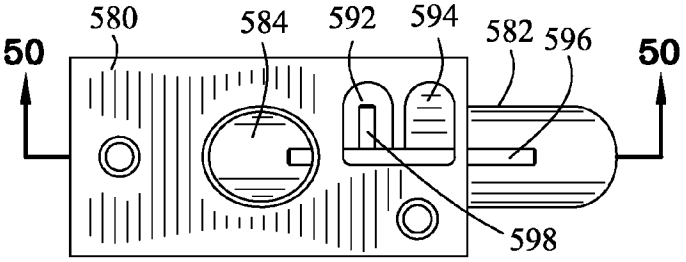
FIG. 49 is a view similar to FIG. 47 illustrating the first mounting pin in an extended position.
Figure 50:
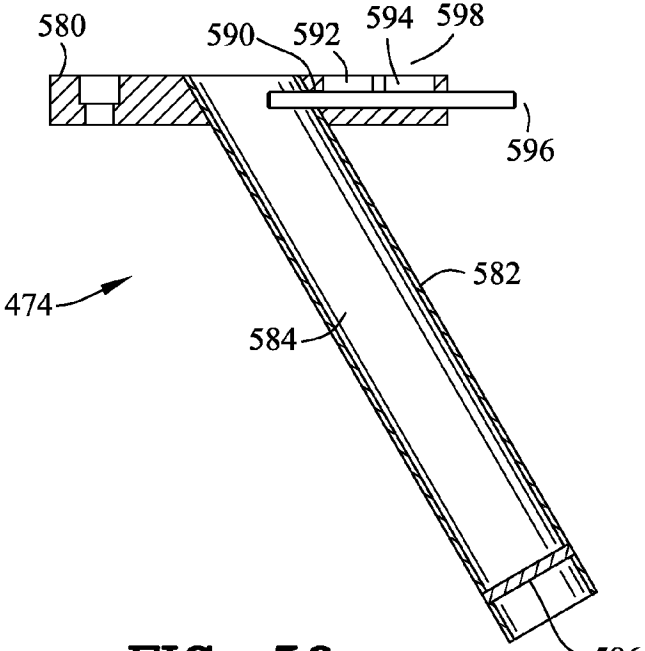
FIG. 50 is a sectional view along line 50-50 in FIG. 49.
Figure 47:
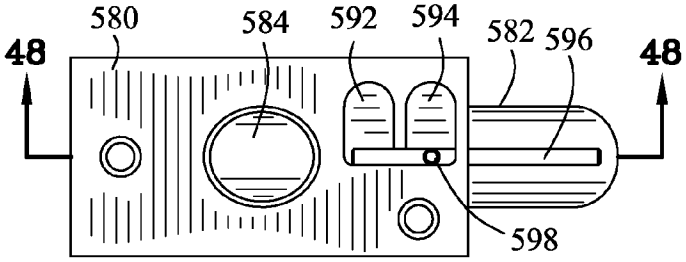
FIG. 47 is a top view of a first anchor wherein a first mounting pin is in a retracted position.
Figure 48:
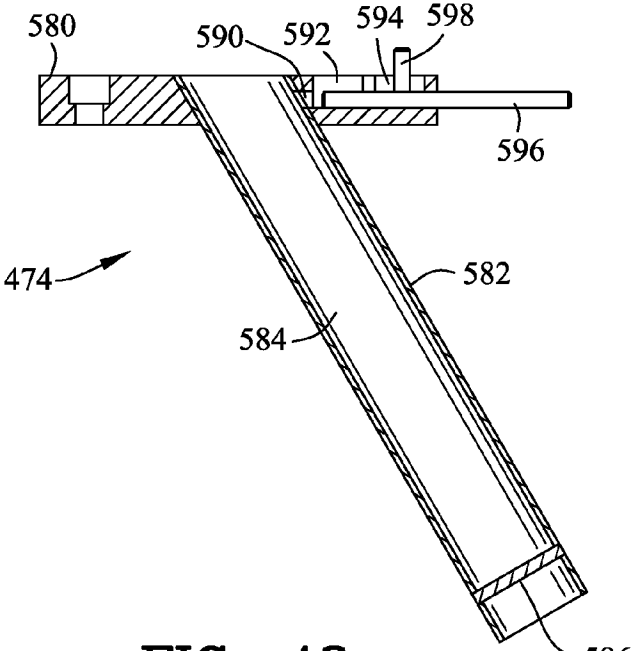
FIG. 48 is a sectional view along line 48-48 in FIG. 47 illustrating the first anchor including a first mounting plate and a first mounting cylinder having a non 90° orientation.
Figure 52:
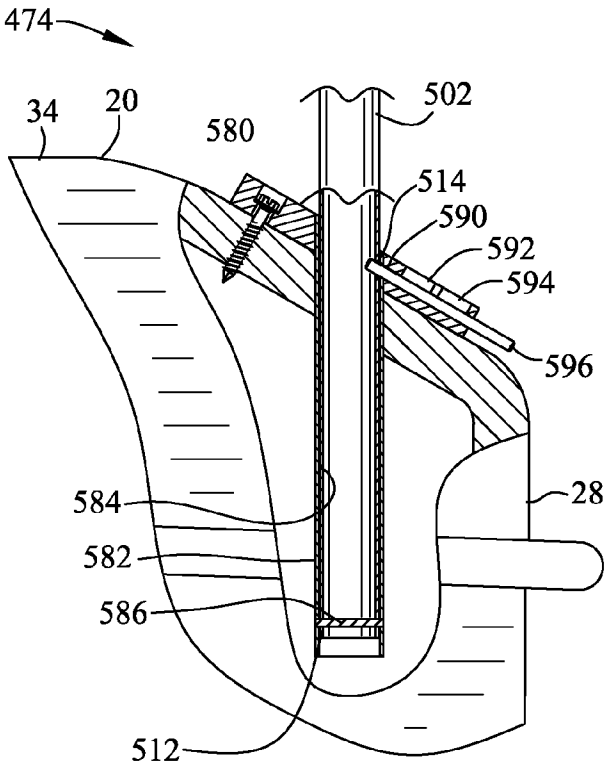
FIG. 52 is a view similar to FIG. 50 wherein the first anchor is secured to the gunnel of a boat and the proximal end of the first telescoping support member is positioned within the first mounting cylinder.
Figure 51:
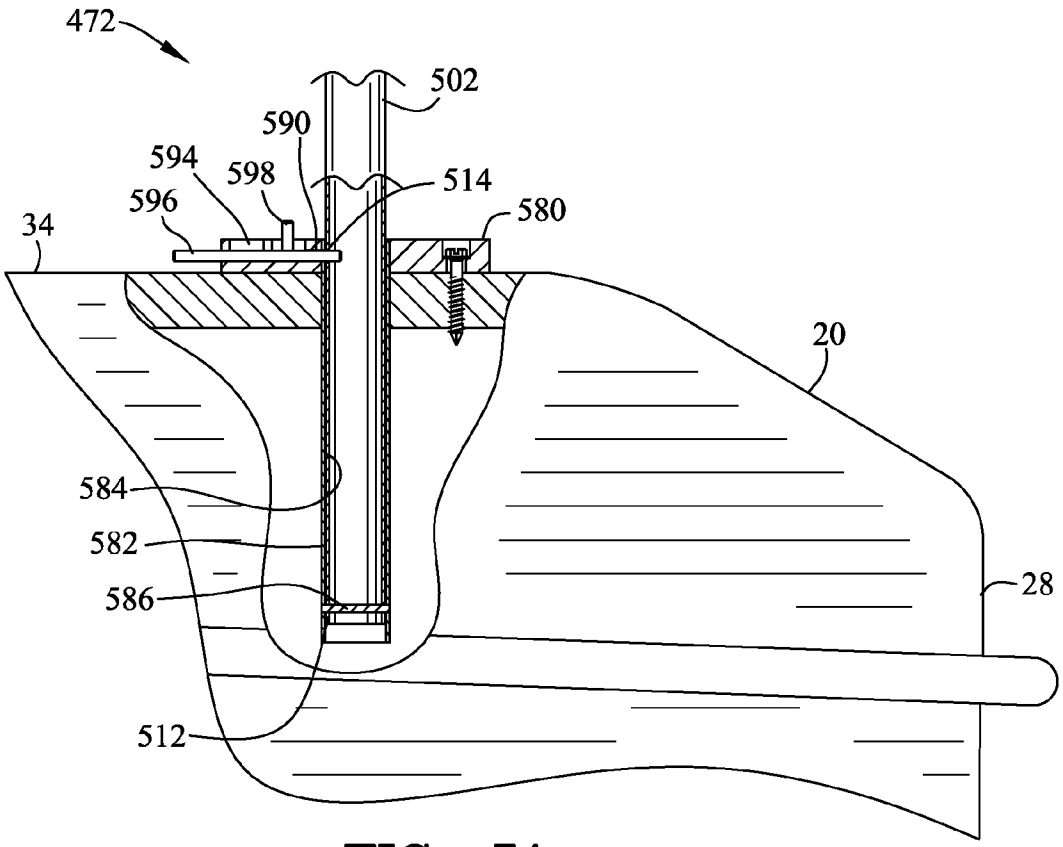
FIG. 51 is a view similar to FIG. 46 wherein the first anchor is secured to the gunnel of a boat and the proximal end of the first telescoping support member is positioned within the first mounting cylinder.

As shown in FIGS. 43-52 the first anchor 280 includes a first mounting plate 580 and first mounting cylinder 582. The first mounting cylinder 582 defines a first cylinder bore 584 for receiving the proximal end 82 of the first telescoping support member 80. The first cylinder bore 584 may include a first rod stopping pin 586 traversing the first cylinder bore 584. The first rod stopping pin 586 is mated with a first mounting groove 512 as best shown in FIG. 42A upon the insertion of the proximal end 82 of the first telescoping support member 80 within the first mounting cylinder 582. The engagement between the first rod stopping pin 586 and the first mounting groove 512 prevents rotation of the first telescoping support member 80 relative to the first anchor 280.

The first mounting plate 580 includes a first pin channel 590 intersecting an extended groove portion 592 and a retracted groove portion 594. A first mounting pin 596 slidably engages the first pin channel 590 and extends and retracts from the first cylinder bore 584. The first mounting pin 596 includes a first pin handle 598 for positioning within the retracted groove portion 594 as shown in FIGS. 43, 44, 47 and 48 for locking the first mounting pin 596 in the retracted position. While the first mounting pin 596 is in the retracted position the proximal end 82 of the first telescoping support member 80 may be inserted into the first anchor 280. The first mounting pin 596 traversing into a support bore 598 into a support aperture 514 and within the first telescoping support member 80 for terminating displacement of the first anchor 280 relative to the first telescoping support member 80. The first pin handle 598 is positioned within the extended groove portion 592 as shown in FIGS. 45, 46, 49 and 50 for locking the first mounting pin 596 in the extended position. The second anchor 282 may be similar to the structure of the first anchor 280 including a first mounting plate 580 and first mounting cylinder 582. The first anchor 280 and the second anchor 282 may be mounted to a boat 20.

Figures 53, 53A, 54:
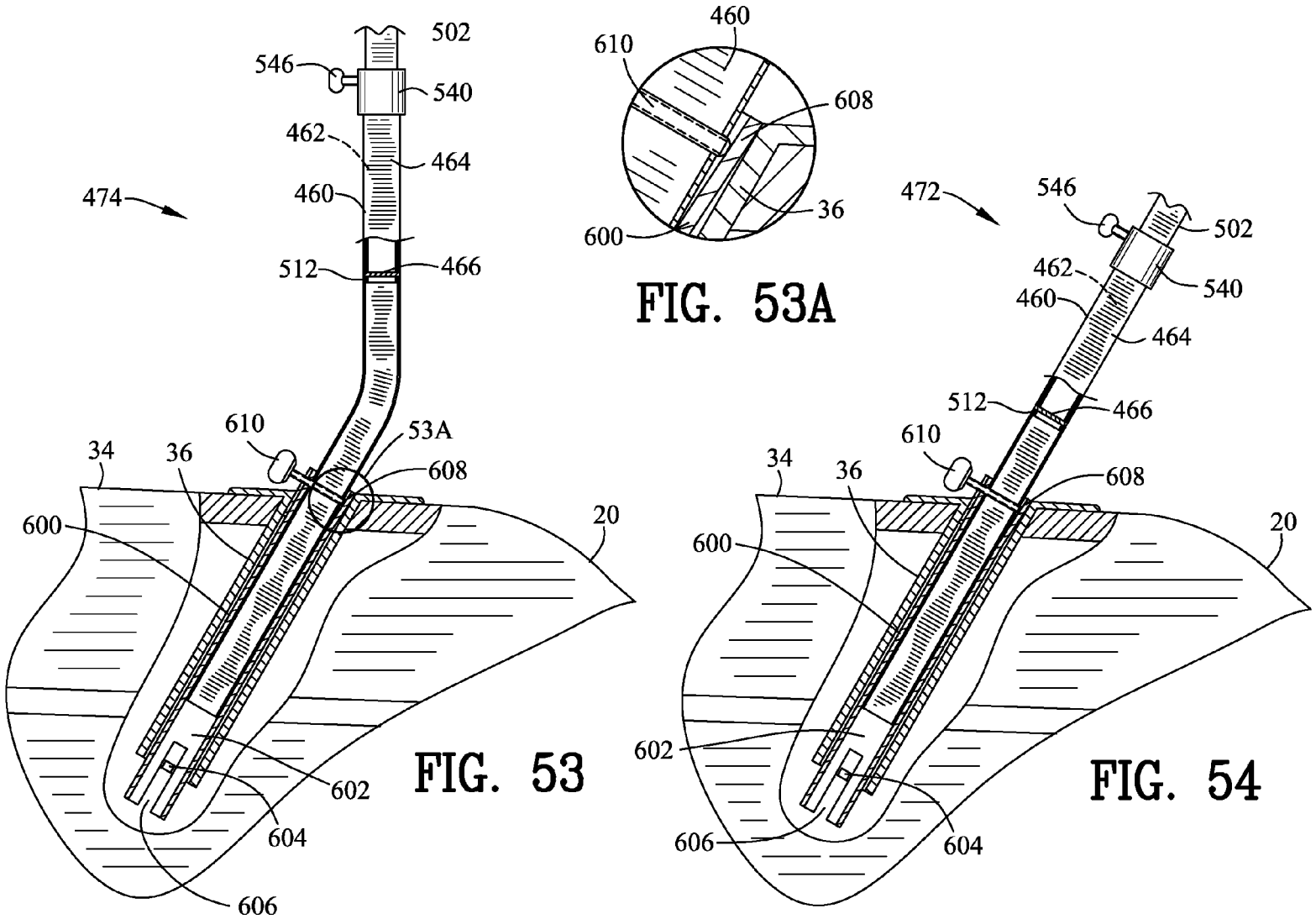
FIG. 53 is a sectional view of the gunnel of a boat wherein the first anchor includes a first fishing rod cylinder for inserting into a first fishing rod holder.
FIG. 53A is an enlarged portion of FIG. 53 illustrating a first locking screw impressing the first locking tab for compressing the first locking tab against the first fishing rod holder and terminating displacement of the first anchor relative to the first fishing rod holder.
FIG. 54 is a view similar to FIG. 53 illustrating a first linear anchor couple for positioning the screen in a greater distance relative to the first fishing rod holder.

As shown in FIGS. 53 and 54 the first anchor 280 may alternatively include a first fishing rod cylinder 600 for inserting into a first fishing rod holder 36. The first fishing rod cylinder 600 defining a first cylinder bore 602 for receiving the proximal end 82 of the first telescoping support member 80.

The first fishing rod holder 36 may include a fishing rod stopping pin 604. The fishing rod stopping pin 604 is mated with a fish mounting groove 606 in the first fishing rod cylinder 600 upon the insertion of the first fishing rod cylinder 600 within the first fishing rod holder 36. The engagement between the fishing rod stopping pin 604 and the fish mounting groove 606 prevents rotation of the first fishing rod cylinder 600 relative to the first fishing rod holder 36.

A first locking tab 608 is integral to the first fishing rod cylinder 600. A first locking screw 610 traverses the first cylinder bore 602 and contacts the first locking tab 608. The first locking screw 610 impressing the first locking tab 608 for compressing the first locking tab 608 against the first fishing rod holder 36 and terminates displacement of the first anchor 280 relative to the first fishing rod holder 36. The second anchor 282 may be similar to the structure of the first anchor 280 including the first fishing rod cylinder 600.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A cantilever canopy for extending over a surface, comprising;

a first telescoping support member extending between a proximal end and a distal end;

a second telescoping support member extending between a proximal end and a distal end;

a telescoping coupling member secured to said distal end of said first telescoping support member and said distal end of said second telescoping support member;

a first telescoping cantilever member extending between a proximal end and a distal end;

a second telescoping cantilever member extending between an proximal end and a distal end;

a first pivot hinge pivotably coupling said distal end of said first telescoping support member with said proximal end of said first telescoping cantilever member;

a second pivot hinge pivotably coupling said distal end of said second telescoping support member with said proximal end of said second telescoping cantilever member;

said first telescoping support member and said second telescoping support member providing a first canopy height and a second canopy height;

said telescoping coupling member providing a first canopy width and a second canopy width;

said first telescoping cantilever member and said second telescoping cantilever member providing a first canopy length and a second canopy length;

said first pivot hinge providing a first angle and a second angle between said first telescoping support member and said first telescoping cantilever member;

said second pivot hinge providing a third angle and a fourth angle between said second telescoping support member and said second telescoping cantilever member;

a first anchor coupling said proximal end of said first telescoping support member to the surface;

a second anchor coupling said proximal end of said second telescoping support member to the surface;

a screen extending between said first telescoping cantilever member and said second telescoping cantilever member for providing shelter under said screen;

a first pivot lock for terminating pivoting of said first telescoping support member relative to said first telescoping cantilever member;

said first pivot lock including a first locking plate and a first locking pin;

said first locking plate coupled to said first telescoping cantilever member;

said first pivot plate having a first plurality of locking grooves;

said first locking pin traversing said distal end of said first telescoping supporting member;

said first locking pin engaging one of said first plurality of locking grooves for terminating pivoting of said first telescoping support member relative to said first telescoping cantilever member and said first locking pin disengaging one of said first plurality of locking grooves for permitting pivoting of said first telescoping support member relative to said first telescoping cantilever member;

a second pivot lock for terminating pivoting of said second telescoping support member relative to said second telescoping cantilever member;

said second pivot lock including a second locking plate and a second locking pin;

said second locking plate coupled to said second telescoping cantilever member;

said second locking plate having a second plurality of locking grooves;

said second locking pin traversing said distal end of said second telescoping support member; and said second locking pin engaging one of said second plurality of locking grooves for terminating pivoting of said second telescoping support member relative to said second telescoping cantilever member and said second locking pin disengaging one of said second plurality of locking grooves for permitting pivoting of said second telescoping support member relative to said second telescoping cantilever member.

2. A cantilever canopy for extending over a surface as set forth in claim 1, wherein said first anchor includes a first fishing rod plug for inserting into a first fishing rod holder; and said second anchor includes a second fishing rod plug for inserting into a second fishing rod holder.

3. A cantilever canopy for extending over a surface as set forth in claim 1, wherein said first anchor includes a first fishing rod cylinder for inserting into a first fishing rod holder;

said first fishing rod cylinder defining a first cylinder bore for receiving said proximal end of said first telescoping support member;

a first locking tab integral to said first fishing rod cylinder;

a first locking screw traversing said first cylinder bore and contacting said first locking tab;

said first locking screw impressing said first locking tab for compressing said first locking tab against the first fishing rod holder and terminating displacement of said first anchor relative to the first fishing rod holder;

said second anchor includes a second fishing rod cylinder for inserting into a second fishing rod holder;

said second fishing rod cylinder defining a second cylinder bore for receiving said proximal end of said second telescoping support member;

a second locking tab integral to said second fishing rod cylinder;

a second locking screw traversing said second cylinder bore and contacting said second locking tab; and said second locking screw impressing said second locking tab for compressing said second locking tab against the second fishing rod holder and terminating displacement of said second anchor relative to the second fishing rod holder.

4. A cantilever canopy for extending over a surface, comprising;

a first telescoping support member extending between a proximal end and a distal end;

a second telescoping support member extending between a proximal end and a distal end;

a telescoping coupling member secured to said distal end of said first telescoping support member and said distal end of said second telescoping support member;

a first telescoping cantilever member extending between a proximal end and a distal end;

a second telescoping cantilever member extending between an proximal end and a distal end;

a first pivot hinge pivotably coupling said distal end of said first telescoping support member with said proximal end of said first telescoping cantilever member;

a second pivot hinge pivotably coupling said distal end of said second telescoping support member with said proximal end of said second telescoping cantilever member;

said first telescoping support member and said second telescoping support member providing a first canopy height and a second canopy height;

said telescoping coupling member providing a first canopy width and a second canopy width;

said first telescoping cantilever member and said second telescoping cantilever member providing a first canopy length and a second canopy length;

said first pivot hinge providing a first angle and a second angle between said first telescoping support member and said first telescoping cantilever member;

said second pivot hinge providing a third angle and a fourth angle between said second telescoping support member and said second telescoping cantilever member;

a first anchor coupling said proximal end of said first telescoping support member to the surface;

a second anchor coupling said proximal end of said second telescoping support member to the surface;

a screen extending between said first telescoping cantilever member and said second telescoping cantilever member for providing shelter under said screen;

said first anchor includes a first fishing rod cylinder for inserting into a first fishing rod holder;

said first fishing rod cylinder defining a first cylinder bore for receiving said proximal end of said first telescoping support member;

a first locking tab integral to said first fishing rod cylinder;

a first locking screw traversing said first cylinder bore and contacting said first locking tab;

said first locking screw impressing said first locking tab for compressing said first locking tab against the first fishing rod holder and terminating displacement of said first anchor relative to the first fishing rod holder;

said second anchor includes a second fishing rod cylinder for inserting into a second fishing rod holder;

said second fishing rod cylinder defining a second cylinder bore for receiving said proximal end of said second telescoping support member;

a second locking tab integral to said second fishing rod cylinder;

a second locking screw traversing said second cylinder bore and contacting said second locking tab; and said second locking screw impressing said second locking tab for compressing said second locking tab against the second fishing rod holder and terminating displacement of said second anchor relative to the second fishing rod holder.

5. A cantilever canopy for extending over a surface, comprising:

a first telescoping support member extending between a proximal end and a distal end;

a second telescoping support member extending between a proximal end and a distal end;

a telescoping coupling member secured to said distal end of said first telescoping support member and said distal end of said second telescoping support member;

a first telescoping cantilever member extending between a proximal end and a distal end;

a second telescoping cantilever member extending between an proximal end and a distal end;

a first pivot hinge pivotably coupling said distal end of said first telescoping support member with said proximal end of said first telescoping cantilever member;

a second pivot hinge pivotably coupling said distal end of said second telescoping support member with said proximal end of said second telescoping cantilever member;

said first telescoping support member and said second telescoping support member providing a first canopy height and a second canopy height;

said telescoping coupling member providing a first canopy width and a second canopy width;

said first telescoping cantilever member and said second telescoping cantilever member providing a first canopy length and a second canopy length;

said first pivot hinge providing a first angle and a second angle between said first telescoping support member and said first telescoping cantilever member;

said second pivot hinge providing a third angle and a fourth angle between said second telescoping support member and said second telescoping cantilever member;

a first anchor coupling said proximal end of said first telescoping support member to the surface;

a second anchor coupling said proximal end of said second telescoping support member to the surface;

a screen extending between said first telescoping cantilever member and said second telescoping cantilever member for providing shelter under said screen;

a first pivot lock coupled to said distal end of said first telescoping supporting member;

said first pivot lock engaging said proximal end of said first telescoping cantilever member for terminating pivoting of said first telescoping support member relative to said first telescoping cantilever member and said first pivot lock disengaging said first telescoping cantilever member for permitting pivoting of said first telescoping support member relative to said first telescoping cantilever member;

a second pivot lock coupled to said distal end of said second telescoping supporting member; and said second pivot lock engaging said proximal end of said second telescoping cantilever member for terminating pivoting of said second telescoping support member relative to said second telescoping cantilever member and said second pivot lock disengaging said second telescoping cantilever member for permitting pivoting of said second telescoping support member relative to said second telescoping cantilever member.

6. A cantilever canopy for extending over a surface as set forth in claim 5, wherein said first anchor includes a first fishing rod plug for inserting into a first fishing rod holder; and said second anchor includes a second fishing rod plug for inserting into a second fishing rod holder.

7. A cantilever canopy for extending over a surface, comprising;

a first telescoping support member extending between a proximal end and a distal end;

a second telescoping support member extending between a proximal end and a distal end;

a telescoping coupling member secured to said distal end of said first telescoping support member and said distal end of said second telescoping support member;

a first telescoping cantilever member extending between a proximal end and a distal end;

a second telescoping cantilever member extending between an proximal end and a distal end;

a first pivot hinge pivotably coupling said distal end of said first telescoping support member with said proximal end of said first telescoping cantilever member;

a second pivot hinge pivotably coupling said distal end of said second telescoping support member with said proximal end of said second telescoping cantilever member;

said first telescoping support member and said second telescoping support member providing a first canopy height and a second canopy height;

said telescoping coupling member providing a first canopy width and a second canopy width;

said first telescoping cantilever member and said second telescoping cantilever member providing a first canopy length and a second canopy length;

said first pivot hinge providing a first angle and a second angle between said first telescoping support member and said first telescoping cantilever member;

said second pivot hinge providing a third angle and a fourth angle between said second telescoping support member and said second telescoping cantilever member;

a first anchor coupling said proximal end of said first telescoping support member to the surface;

a second anchor coupling said proximal end of said second telescoping support member to the surface;

a screen extending between said first telescoping cantilever member and said second telescoping cantilever member for providing shelter under said screen;

a first pivot lock coupled to said proximal end of said first telescoping cantilever member;

said first pivot lock engaging said distal end of said first telescoping supporting member for terminating pivoting of said first telescoping support member relative to said first telescoping cantilever member and said first pivot lock disengaging said first telescoping support member for permitting pivoting of said first telescoping support member relative to said first telescoping cantilever member;

a second pivot lock coupled to said proximal end of said second telescoping cantilever member; and said second pivot lock engaging said distal end of said second telescoping supporting member for terminating pivoting of said second telescoping support member relative to said second telescoping cantilever member and said second pivot lock disengaging said second telescoping support member for permitting pivoting of said second telescoping support member relative to said second telescoping cantilever member.

8. A cantilever canopy for extending over a surface as set forth in claim 7, wherein said first anchor includes a first fishing rod plug for inserting into a first fishing rod holder; and said second anchor includes a second fishing rod plug for inserting into a second fishing rod holder.

* * * * *